US012275442B2

(12) United States Patent
Cortez et al.

(10) Patent No.: US 12,275,442 B2
(45) **Date of Patent: *Apr. 15, 2025**

(54) RAILCAR DOOR OPERATING SYSTEMS AND METHODS WITH CAPSTAN DRIVES

(71) Applicant: Trinity Rail Group, LLC, Dallas, TX (US)

(72) Inventors: Daniel G. Cortez, Grapevine, TX (US); Lee A. Reitz, Euless, TX (US); Jerry W. Vande Sande, Dallas, TX (US); Carter R. Andrews, Dallas, TX (US); Kenneth W. Huck, Fairview, CA (US); Craig J. Stevens, Grand Prairie, TX (US); William F. Deakyne, Arlington, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/454,943

(22) Filed: Aug. 24, 2023

(65) Prior Publication Data

US 2023/0399032 A1 Dec. 14, 2023

Related U.S. Application Data

(63) Continuation of application No. 17/080,921, filed on Oct. 27, 2020, now Pat. No. 11,738,783.

(60) Provisional application No. 62/926,928, filed on Oct. 28, 2019.

(51) Int. Cl.
*B61D 7/02* (2006.01)

(52) U.S. Cl.
CPC ..... *B61D 7/02* (2013.01)

(58) Field of Classification Search
CPC ..... B61D 7/02; B61D 7/04
See application file for complete search history.

(56) References Cited

U.S. PATENT DOCUMENTS 11,738,783 B2 * 8/2023 Cortez ..... B61D 7/02 105/245
2010/0275811 A1 11/2010 Creighton

OTHER PUBLICATIONS

Canadian Patent Office Official Action in CA 3,097,156, dated Jan. 31, 2024.

* cited by examiner

*Primary Examiner* — Robert J McCarry, Jr.
(74) *Attorney, Agent, or Firm* — Baker Botts L.L.P.

(57) ABSTRACT

According to some embodiments, a longitudinal door system comprising one or more longitudinal doors for a railcar and a longitudinal operating beam coupled to the one or more longitudinal doors via one or more struts. A translation of the longitudinal operating beam is coupled to an opening and closing of the one or more longitudinal doors. The door system further comprising a gearbox coupled to the longitudinal operating beam and a first capstan receptacle. The gearbox is operable to translate a rotational movement of the first capstan receptacle to a linear movement of the longitudinal operating beam.

19 Claims, 23 Drawing Sheets

RAILCAR DOOR OPERATING SYSTEMS AND METHODS WITH CAPSTAN DRIVES

PRIORITY

This application claims priority, under 35 U.S.C. § 119(e), to U.S. Provisional Patent Application No. 62/926,928 filed Oct. 28, 2019, titled "RAILCAR DOOR OPERATING SYSTEMS AND METHODS WITH CAPSTAN DRIVES," which is hereby incorporated by reference in its entirety.

TECHNICAL FIELD

This disclosure relates generally to railcars and railcar doors, and more particularly to operating railcar doors using a capstan drive.

BACKGROUND

Capstan drives have been used for opening sliding gates on railcars, particularly hopper railcars, for many years and thus are widely used in the industry. Using capstan drives to open longitudinal doors on railcars exhibit inherent problems with doing so. Capstan drives are available from multiple manufacturers in a variety of speed and torque ranges that make them difficult to implement on a railcar. When used for sliding gates, their characteristics are not as problematic as they usually drive a pinion gear-type mechanism. For longitudinal door-style railcars, these characteristics need to be accounted for.

SUMMARY

A problem with capstan driven railcar doors is that capstan drives come in various configurations with different torque and speed capabilities. Thus, a railcar door system should be able to handle the various operating ranges without suffering damage to the railcar door system or other railcar components. Particular embodiments provide solutions to these and other problems.

According to some embodiments, a longitudinal door system comprising one or more longitudinal doors for a railcar and a longitudinal operating beam coupled to the one or more longitudinal doors via one or more struts. A translation of the longitudinal operating beam is coupled to an opening and closing of the one or more longitudinal doors. The door system further comprising a gearbox coupled to the longitudinal operating beam and a first capstan receptacle. The gearbox is operable to translate a rotational movement of the first capstan receptacle to a linear movement of the longitudinal operating beam.

In particular embodiments, the gearbox is coupled to the longitudinal operating beam via a threaded shaft coupled to the rotation provided by the first capstan receptacle, and a nut disposed on the threaded shaft and coupled to the longitudinal operating beam. The nut is configured to move along the threaded shaft as the threaded shaft rotates and causes movement of the longitudinal operating beam in the direction of the movement of the nut.

In particular embodiments, the door system further comprises a re-engaging spring disposed at a first end of the threaded shaft. The re-engaging spring provides a restorative force to the nut in a first direction when the threaded shaft does not rotate or rotates in a first direction. The door system may further comprise a second re-engaging spring disposed at a second end of the threaded shaft. The re-engaging spring provides a restorative force to the nut in a second direction when the threaded shaft does not rotate or rotates in a second direction.

In particular embodiments, the door system further comprises a shearing pin disposed between the gearbox and the first capstan receptacle. The shear pin is configured to shear and reduce or eliminate the coupling between the gearbox and the first capstan receptable in response to a torque exceeding a predetermined value. Some embodiments further comprise a torque limiter disposed between the gearbox and the first capstan receptacle. The torque limiter limits the torque translated from the first capstan receptacle to the gearbox.

In particular embodiments, the gearbox is coupled to the longitudinal operating beam via one of a torque limiter, a continuously variable transmission, a centrifugal clutch, and a torque converter.

In particular embodiments, the door system further comprising a second capstan receptacle. The first capstan receptacle and the second capstan receptacle are coupled differently (e.g., one high speed, one low speed, one high torque, one low torque, etc.) via the gearbox to the longitudinal operating beam.

In particular embodiments, the door system further comprises a spring or damper at each end of the longitudinal operating beam. The spring or damper is configured to provide a restorative force to the longitudinal operating beam moving in the direction towards the spring or dampening mechanism.

In particular embodiments, the door system comprises a torsional dampener coupled between the gearbox and the first capstan receptacle configured to dampen variations of torque received from a capstan drive.

In particular embodiments, the gearbox is coupled to the longitudinal operating beam via a rack and pinion system, and a ratchet configured to control the movement or speed of the longitudinal operating beam in both directions of travel of the longitudinal operating beam.

In particular embodiments, the gearbox is slidably coupled to the longitudinal operating beam.

In particular embodiments, the gearbox is coupled to the longitudinal operating beam via a rod and clevis. An end of the rod comprises a rod housing and the clevis is partially disposed within the rod housing. The rod housing is configured to reduce torsional flex imparted to the longitudinal operating beam.

According to some embodiments, the door system further comprises a second capstan receptacle coupled to the gearbox. The first capstan receptacle extends toward a first side of the railcar, and the second capstan receptacle extends toward a second side of the railcar. A security system comprises a first security seal for the first capstan receptacle and a second security seal for the second capstan receptacle. The first and second security seals are configured to indicate whether the first and second capstan receptacles have been accessed since installation of the security seal.

In particular embodiments, the first capstan receptacle is coupled to a first cover through which the first security seal is secured, and a first hood disposed over the first capstan receptacle. The second capstan receptacle is coupled to a second cover through which the second security seal is secured, and a second hood disposed over the second capstan receptacle. The first hood is coupled to the second hood such that movement of the first hood results in movement of the second hood.

In particular embodiments, the longitudinal operating beam is coupled to the first and second capstan receptacles via a control rod extending along the direction of movement of the longitudinal operating beam. The first security seal may not be attached to the first cover and first capstan receptacle unless the first hood and first cover are in a closed position. The first hood may not be closed when the longitudinal operating beam and the doors are in an open position. The first security seal and the second security seal provide a visual indication when the one or more doors of the railcar are not completely closed. When the first hood is open, the second security seal may not be visible.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Some of the embodiments contemplated herein will now be described more fully with reference to the accompanying drawings. Other embodiments, however, are contained within the scope of the subject matter disclosed herein, the disclosed subject matter should not be construed as limited to only the embodiments set forth herein; rather, these embodiments are provided by way of example to convey the scope of the subject matter to those skilled in the art.

Generally, all terms used herein are to be interpreted according to their ordinary meaning in the relevant technical field, unless a different meaning is clearly given and/or is implied from the context in which it is used. All references to a/an/the element, apparatus, component, means, step, etc. are to be interpreted openly as referring to at least one instance of the element, apparatus, component, means, step, etc., unless explicitly stated otherwise. The steps of any methods disclosed herein do not have to be performed in the exact order disclosed, unless a step is explicitly described as following or preceding another step and/or where it is implicit that a step must follow or precede another step. Any feature of any of the embodiments disclosed herein may be applied to any other embodiment, wherever appropriate. Likewise, any advantage of any of the embodiments may apply to any other embodiments, and vice versa. Other objectives, features, and advantages of the enclosed embodiments will be apparent from the following description.

Certain embodiments of the present disclosure may provide one or more technical advantages. For example, certain embodiments facilitate use of capstan drives for operating longitudinal doors on a railcar. Certain embodiments flexibly facilitate the use of capstan drives of various operating speeds and forces from either side of the railcar to operate the doors. As another example, certain embodiments provide a security seal mechanism to secure the railcar from unauthorized use while facilitating visual confirmation of railcar security and confirmation that the longitudinal doors are fully closed from either side of the railcar. Certain embodiments may have none, some, or all of the above-recited advantages. Other advantages may be readily apparent to one having skill in the art.

Figure 1:
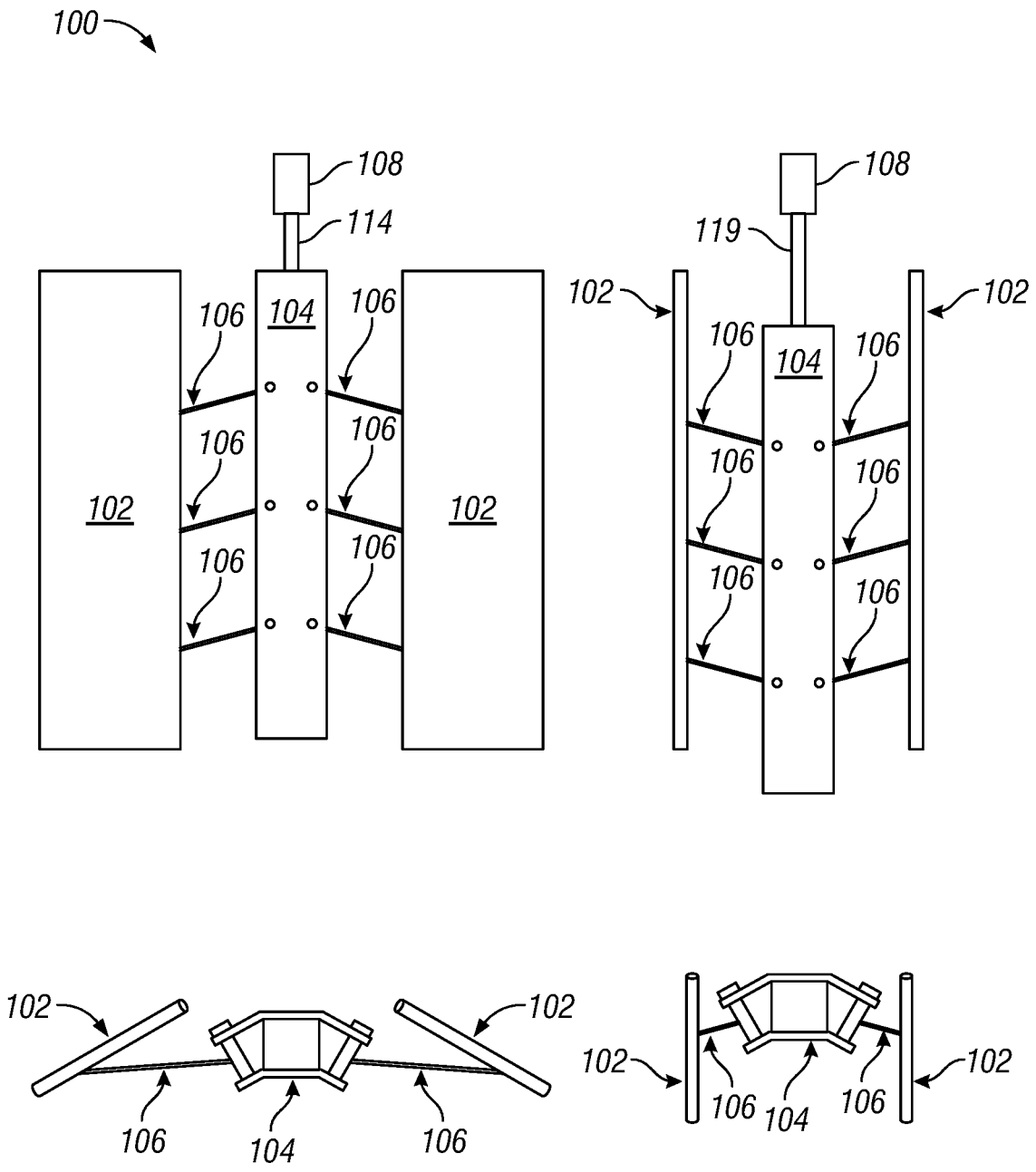
FIG. 1 illustrates an example longitudinal door system, in accordance with certain embodiments.

As described above, certain embodiments described herein provide new and improved incorporation of capstan drives to open and close longitudinal doors on railcars, such as hopper and gondola railcars. FIG. 1 illustrates an example longitudinal door system, in accordance with certain embodiments. Longitudinal door system 100 may include one or more doors 102 attached to sliding longitudinal beam 104 via struts 106. When longitudinal beam 104 travels in one direction, struts 106 may open doors 102. When longitudinal beam 104 travels in the opposite direction, struts 106 may close doors 102.

In certain embodiments, longitudinal door system 100 may include or be coupled to capstan drive mechanism 108. Capstan drive mechanism 108 may apply torque through a rotating shaft and a gearbox to, in combination, translate the rotational movement applied to capstan drive mechanism 108 into linear motion of rod 114 coupling capstan drive mechanism 108 to longitudinal beam 104. The linear motion of rod 114 moves longitudinal beam 104 back and forth to open and close doors 102. For example, longitudinal beam 104 may be moved from a first position in which the door or doors 102 are closed (on the left side of FIG. 1) to a second position in which the door or doors 102 are open (on the right side of FIG. 1).

In certain embodiments, the gear box is designed to accept a capstan drive from either side of the railcar. For example, there may be two or more capstan inputs for the capstan mechanism, with at least one accessible from each side of the railcar (see FIG. 2).

Capstan drives, depending upon the manufacturer and design, are available in a range of torque capabilities. For example, this range can vary from 26 ft-lbs to as much as 3000 ft-lbs of torque. Additionally, the rotational speeds can range from 4 rotations per minute (rpm) to as much as 1400 rpm or more. Accordingly, some of the torques and/or speeds within the range of capstan drives have the potential to damage railcar equipment without proper coupling mechanism in place, as are described herein.

Although particular examples describe capstan drives (e.g., manual, electric, pneumatic, etc.) to operate the mechanism, other means may be used. For example, a handheld electric drill, wireless or corded, may provide rotational force to operate the railcar doors. Additionally, an electric motor may be used to rotate the mechanism or any other means may be used to apply a rotational force to the gear box, including a bar or wrench operated manually.

Capstan Drive Mechanism Embodiments

Figure 2:
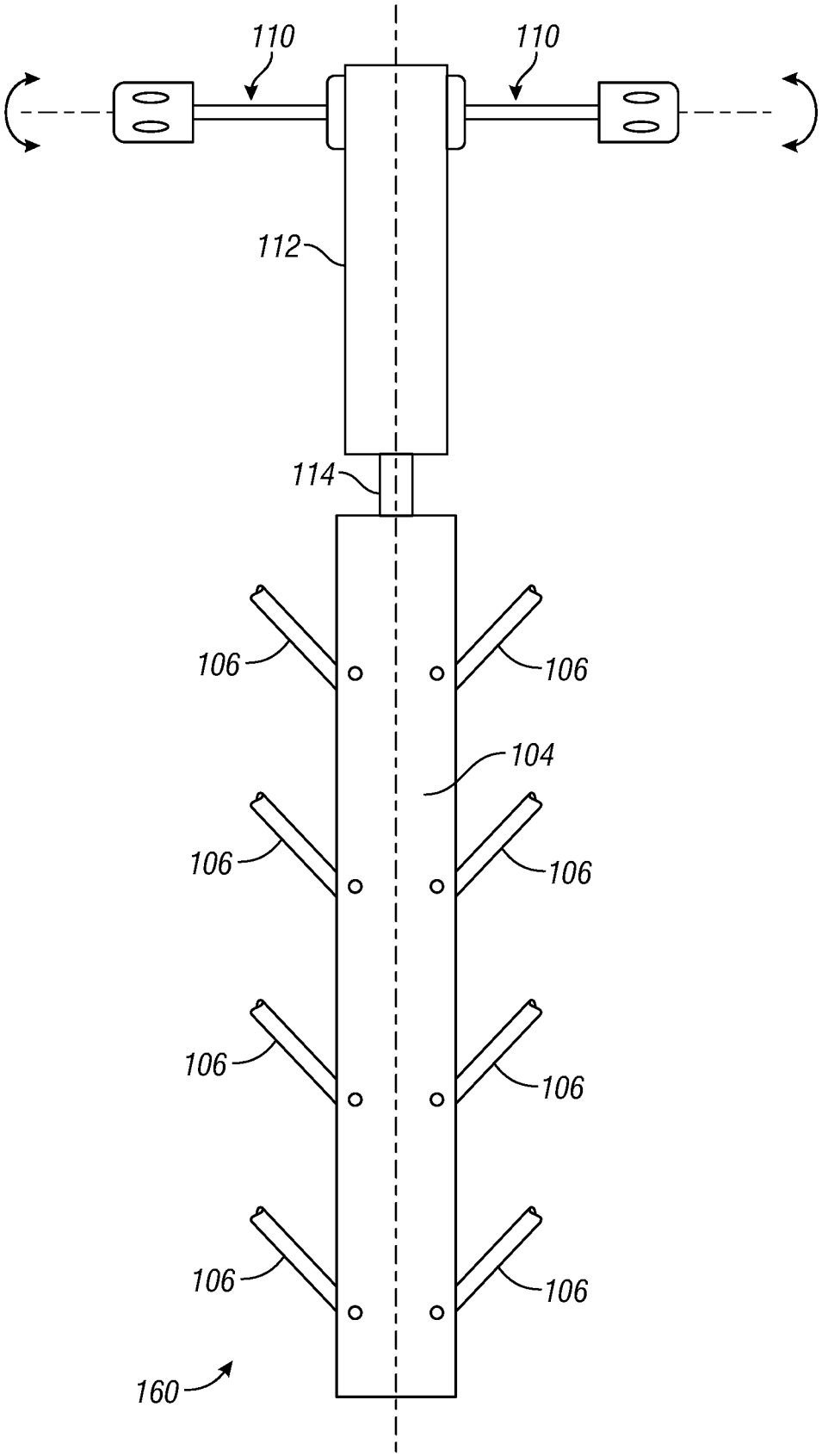
FIG. 2 illustrates an example longitudinal door system including a rotating shaft.

FIG. 2 illustrates an example longitudinal door system including a rotating shaft. Longitudinal door system 100 is similar to that illustrated in FIG. 1, where the capstan drives mechanism includes two rotating shafts 110 coupled to gearbox 112. One rotating shaft 110 extends towards one side of the railcar, and the other rotating shaft 110 extends to the opposite side of the railcar so that the capstan drive mechanism may be operated from either side of the railcar. Rotating shafts 110 engage gearbox 112 to translate rotational movement of rotating shafts 110 to linear movement of rod 114.

Figure 3:
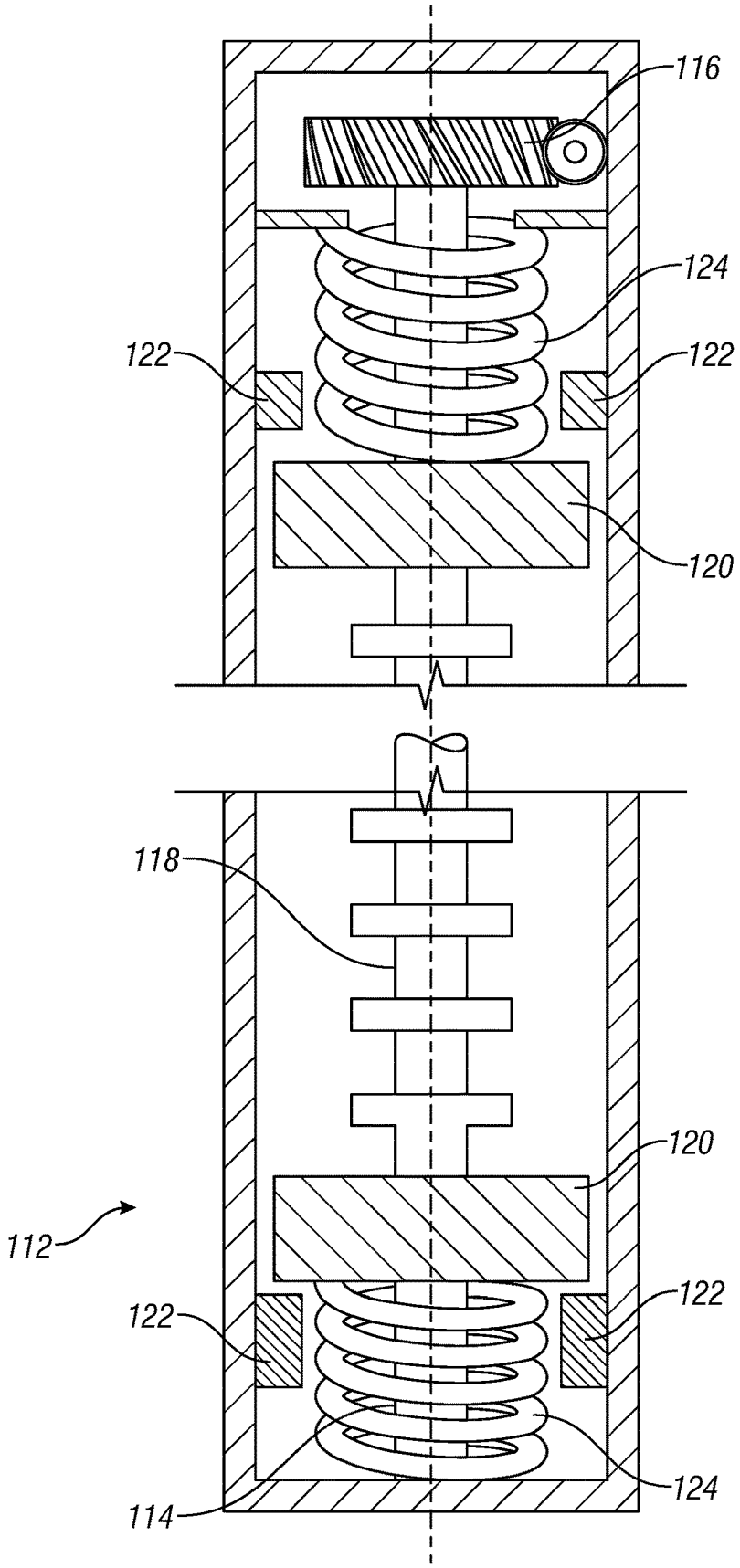
FIG. 3 illustrates a particular example configuration of the gear box coupled to the operating beam.

FIG. 3 illustrates a particular example configuration of the gearbox coupled to the longitudinal operating beam. In certain embodiments, gearbox 112 uses helical cut gears 116 to translate the rotation of the capstan drive shaft into rotation of threaded shaft 118. Nut 120 on threaded shaft 118 is attached to a rod and clevis that is pinned to the longitudinal beam, thereby preventing nut 120 from rotating. Thus, rotation of threaded shaft 118 causes nut 120 to translate longitudinally. As the nut moves linearly, the rod and clevis attached to it and the longitudinal beam causes the longitudinal beam to move linearly, thereby opening and closing the longitudinal doors.

To open the longitudinal doors, the capstan drive is engaged to gearbox 112. Rotation of the capstan drive shaft in a first rotational direction causes nut 120 to move in a first direction and thus the longitudinal beam to move in the same direction. After a pre-determined amount of travel, the longitudinal doors may be fully open. Continued operation of the capstan drive after the door is fully open could impart unwanted and potentially damaging forces into the longitudinal door system and railcar.

Additionally, rotating the capstan drive in a second rotational direction causes nut 120 to move in a second direction and causes the beam to also move in a second direction. After a pre-determined amount of travel, the longitudinal doors are fully closed. Continued operation of the capstan drive after the door is fully closed could also subject the longitudinal door system and railcar to unwanted forces and/or strain.

In certain embodiments, the longitudinal door system includes mechanical stop 122 with sufficient strength to withstand the applied forces from the capstan drive. For example, mechanical stop 122 may prevent the translation of the nut on threaded shaft 118 (also referred to as the threaded rod or screw) by retarding the rotation of threaded shaft 118 through a counter torque that can overcome the torque applied at the capstan drive. In certain embodiments, nut 120 may bottom out in the housing for threaded shaft 118 to prevent additional linear motion and prevent excessive forces from being imparted to the door system.

In particular, nut 120 may be configured to become disengaged from threaded shaft 118 at each end of the desired travel. As a result, continued operation of the capstan drive and continued rotation of threaded shaft 118 do not cause nut 120 to travel further and potentially damage one or more components of the longitudinal door system.

In certain embodiments, when the door is fully open, the nut may be held against threaded shaft 118 with spring 124 such that when the rotation of the threaded shaft is reversed (e.g., to start closing the door), by changing the capstan drive rotation from a first direction to a second direction, spring 124 provides a restorative force and pushes nut 120 to re-engage the threads on threaded shaft 118. Accordingly, nut 120 may begin to move in a second direction, which may move the longitudinal beam in a second direction to close the longitudinal doors.

A similar mechanism may be employed at the location of nut 120 when the longitudinal doors are fully closed. Nut 120 may become disengaged from threaded shaft 118 such that continued rotation of threaded shaft 118 does not translate into linear motion of nut 120. A spring (e.g., spring 124) or other restorative force mechanism may be used to push nut 120 against the threads of threaded shaft 118 such that a change in rotational direction of threaded shaft 118, due to the capstan drive changing from a second rotational direction to the first rotational direction, will allow the nut threads to re-engage the threads on threaded shaft 118 and begin to move nut 120 in the first direction.

In this manner, the longitudinal force mechanism, e.g., the nut, may be engaged and disengaged in a suitable manner to ensure the door or doors are completely open and/or closed without continuing to travel beyond the end points of such motion. As a result, the imparting of unnecessary forces is avoided with wide tolerances of operation of the capstan mechanism or rotating force applier.

Figure 4A:
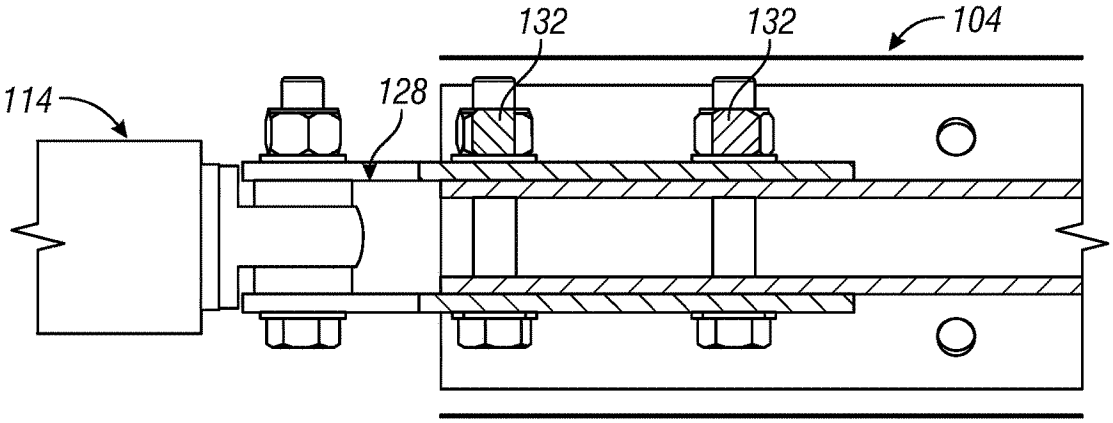
FIGS. 4A-4C illustrate an example coupling between the operating mechanism coupled to the capstan drive and the operating beam.
Figure 4B:
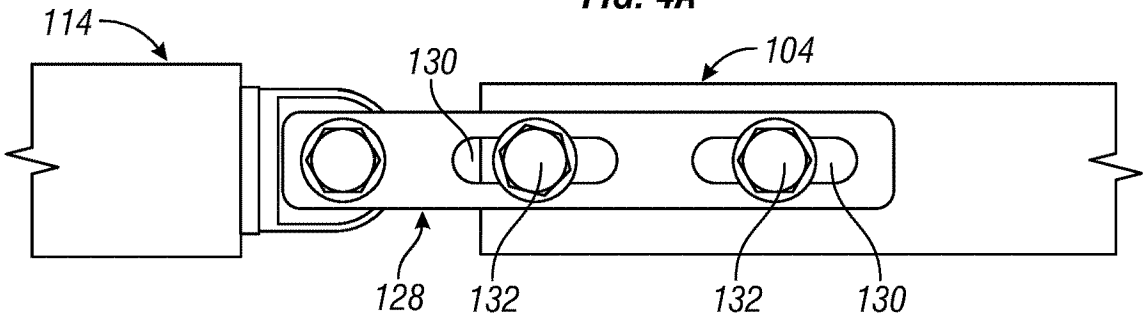
Figure 4C:
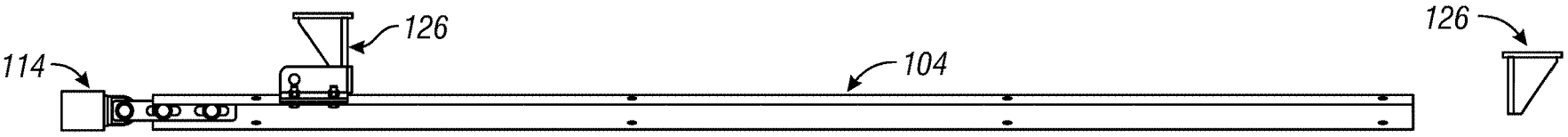

FIGS. 4A-4C illustrate an example coupling between the operating mechanism coupled to the capstan drive and the operating beam. FIG. 4A is an overhead plan view of the coupling between the operating mechanism coupled to the capstan drive and the operating beam and FIG. 4B is a side view.

For example, the operating mechanism may include the rotating shaft and gearbox that provides the longitudinal force and movement to longitudinal beam 104, as described herein. In the illustrated example, the capstan drive (e.g., via rod 114) is slidably coupled to longitudinal beam 104 using slotted connector coupling mechanism 128. Slotted connector 128 may provide one or more technical advantages in the operation of the longitudinal door system.

In particular, slotted connector 128 may enable the operating mechanism to engage and disengage itself smoothly and prevent door and beam forces from preloading the capstan mechanism. The length and placement of slots 130 in slotted connector 128 may be used to provide a buffer in the operation of the longitudinal door system.

For example, when the longitudinal beam is moved from the "door open" position to the "door closed" position and when the doors are fully closed the longitudinal beam may contact a beam stop or another stationary location on the railcar to prevent further movement of the doors. An example is illustrated in FIG. 4C.

FIG. 4C illustrates a longitudinal operating beam with beam stops. Beam stops 126 may restrict further movement of longitudinal beam 104 when longitudinal beam 104 reaches the fully open or fully closed position.

In certain embodiments, slots 130 permit the capstan mechanism to continue moving, at least some distance, by permitting connectors 132 between the capstan mechanism and longitudinal beam 104 to move within slots 130. Accordingly, continued forces after the doors are closed (or conversely opened) may, instead of being imparted to longitudinal beam 104 and between longitudinal beam 104 and beam stop 126, be translated to moving longitudinal beam 104 within slots 130 of slotted connector 128. Likewise, the movement within slotted connector 128 may prevent the forces to be imparted within the capstan mechanism, e.g., the threaded rod and nut gear box and/or rotating shaft, which could damage it.

Figure 5:
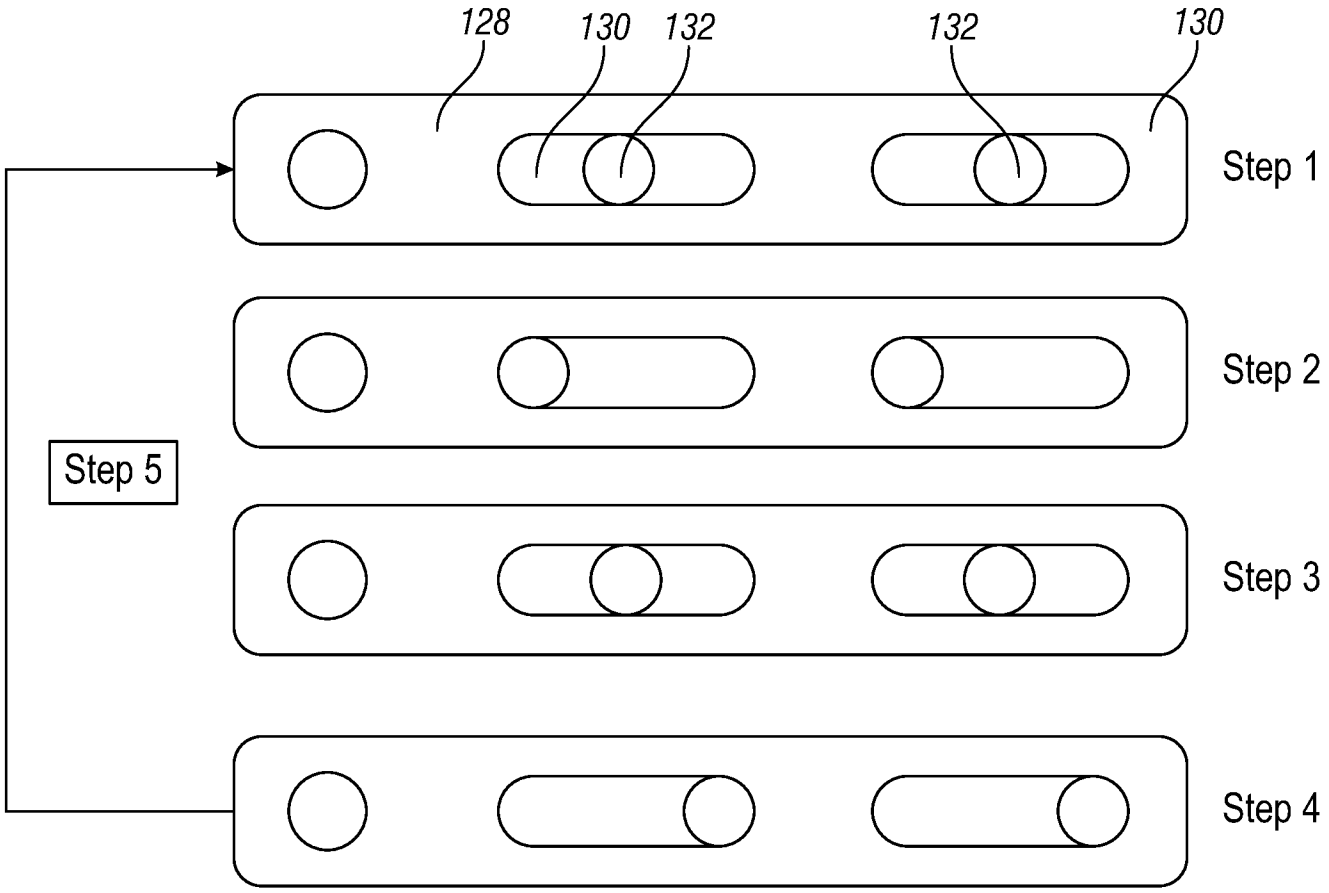
FIG. 5 illustrates a close-up view of the slotted connector during different phases of the door opening and closing operation.

FIG. 5 illustrates a close-up view of the slotted connector during different phases of the door opening and closing operation. For example, at Step 1, the door is in the initial condition of being closed without any current capstan operation. For example, the longitudinal beam may be resting against a first beam stop and connectors 132 may be positioned in the center of slots 130.

At step 2, the capstan mechanism may be energized to open the doors (e.g., the nut re-engages onto the threaded capstan mechanism) without any external forces from the door mechanism. As a result, the capstan mechanism moves relative to the longitudinal beam as connectors 132 move within slots 130 until they contact the left end of slot 130. Continued operation of the capstan mechanism pushes the longitudinal beam to open the doors until the longitudinal beam contacts a second beam stop corresponding to an opened position of the doors.

Step 3 illustrates the point during which the longitudinal beam contacts the second beam stop and the capstan mechanism continues to move relative to the now stationary longitudinal beam until connectors 132 are centered in slots 130. At this point, all door and beam forces are contained to themselves and the nut may disengage from the capstan threaded mechanism, thereby ending the translation of the operating mechanism.

The doors may be later closed, e.g., before the railcar is moved after offloading cargo. At step 4, the capstan mechanism is energized to close the doors (e.g., the capstan threaded mechanism turns in the opposite direction and re-engages the nut onto the threaded portion). Continued operation of the capstan drive moves connectors 132 within slots 130 until they contact the right end of slot 130. Continued operation now moves the longitudinal beam and the doors to the closed position until the longitudinal beam engages the first beam stop corresponding to the closed position. At step 5, continued operation of the capstan drive moves connectors 132 to the middle of slots 130 at which point the nut disengages from the capstan threaded mechanism with no forces imparted from the door and beam system. In this manner, the operating mechanism may be coupled to the longitudinal beam that provides a buffer for the starting and stopping of the capstan rotation, thereby limiting the shock or higher-order forces that may be imparted into the longitudinal door system.

Figure 6:
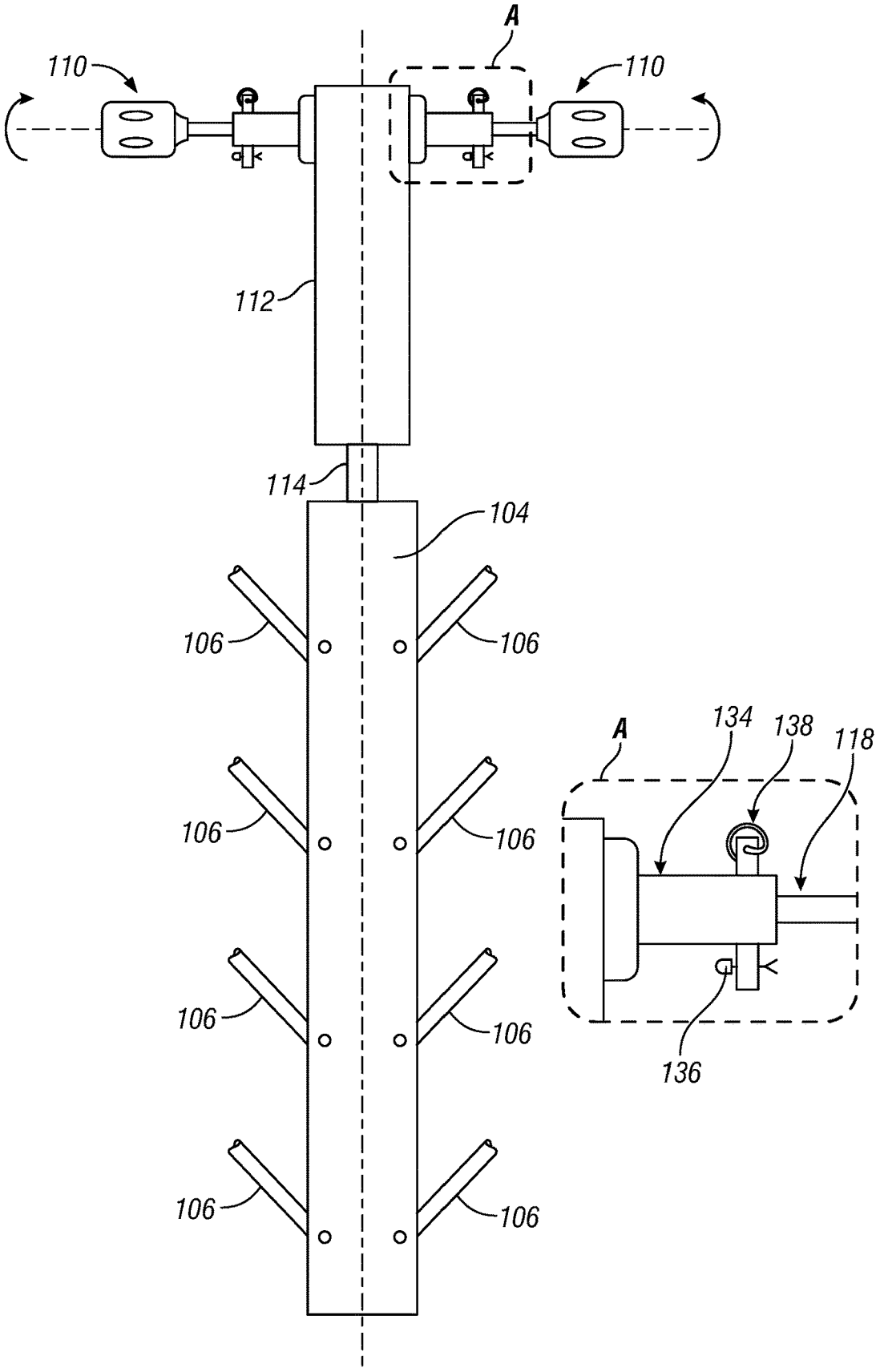
FIG. 6 illustrates a first example of a rotational force limiter that is coupled to the rotational input, e.g., via the capstan.

FIG. 6 illustrates a first example of a rotational force limiter that is coupled to the rotational input, e.g., via the capstan. In certain embodiments, the capstan drive rotational force may be limited by using a shear pin. In particular, when the door(s) are fully open or fully closed, should the capstan drive forces exceed a predetermined level, the shear pin may shear, thereby decoupling the rotational input and the gear box, to protect the door system and railcar.

For example, as illustrated in FIG. 4, rotating shaft 110 may be coupled to shaft coupling 134 of gearbox 112 via cotter retaining pin 136 and shear pin 138. If the torque applied between shaft coupling 134 and rotating shaft 110 exceeds a predetermined amount of torque, shear pin 138 may shear, thereby allowing rotating shaft 110 to freely spin within shaft coupling 134 without imparting most if not all of any torsional force to shaft coupling 134 to the gearbox 112. In this manner, shear pin 138 may be adopted for use to prevent over torqueing when the doors are at either of their respective end positions.

Figure 7:
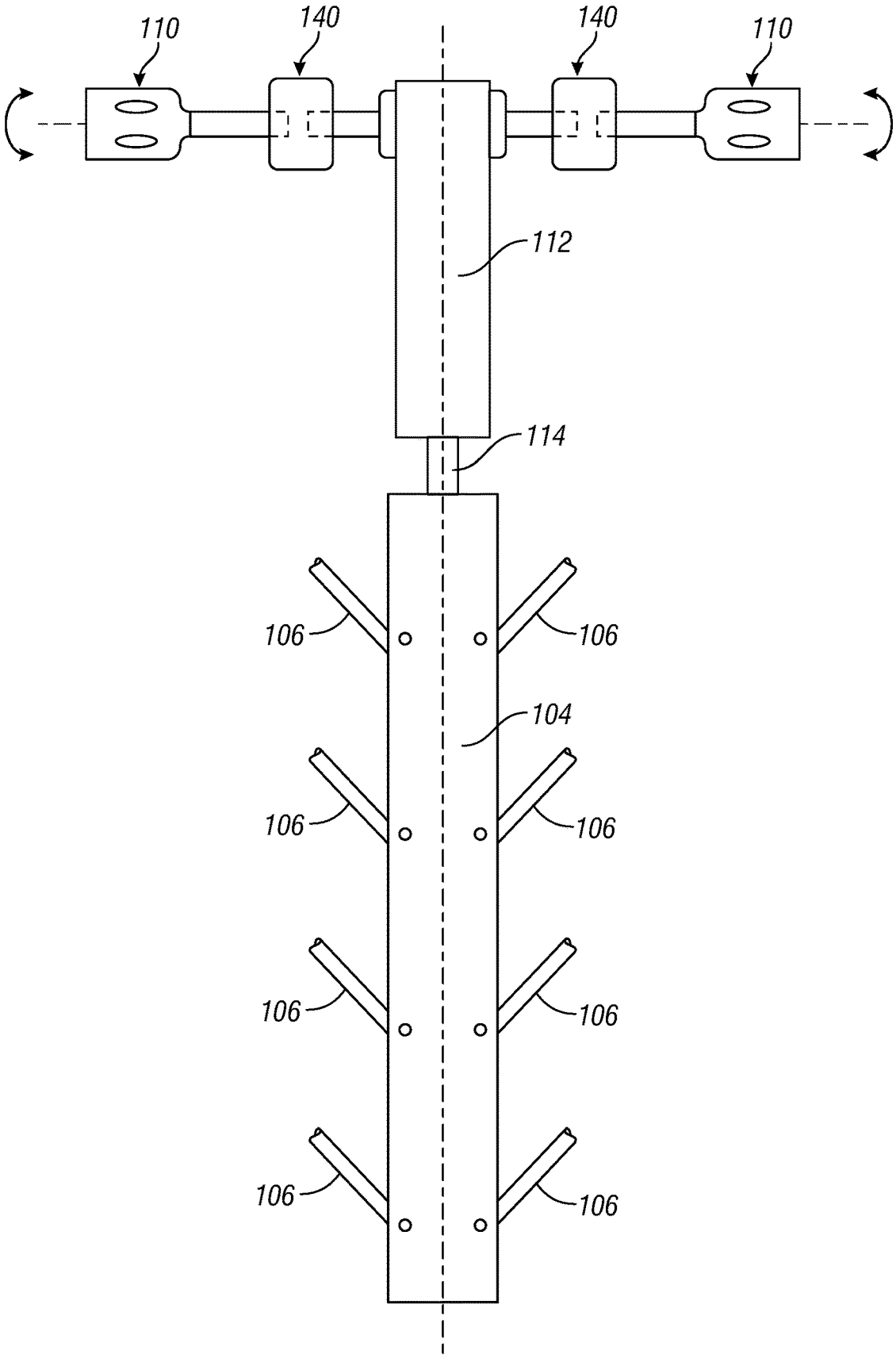
FIG. 7 illustrates a second example of a rotational force limiter.

FIG. 7 illustrates a second example of a rotational force limiter. In certain embodiments, torque limiter 140 may be disposed between rotating shaft 110 and the gearbox 112 to limit the torque applied by the capstan drive to gearbox 112. For example, in some embodiments, torque limiter 140 may be one of a variety of slip clutches that are configured to slip (or rotate without imparting torsional force) when the torque exceeds a predetermined amount. When the torque has reduced, the torque limiter may re-engage, e.g., when the capstan drive is reversed to reverse the longitudinal position of the longitudinal beam.

Figure 8:
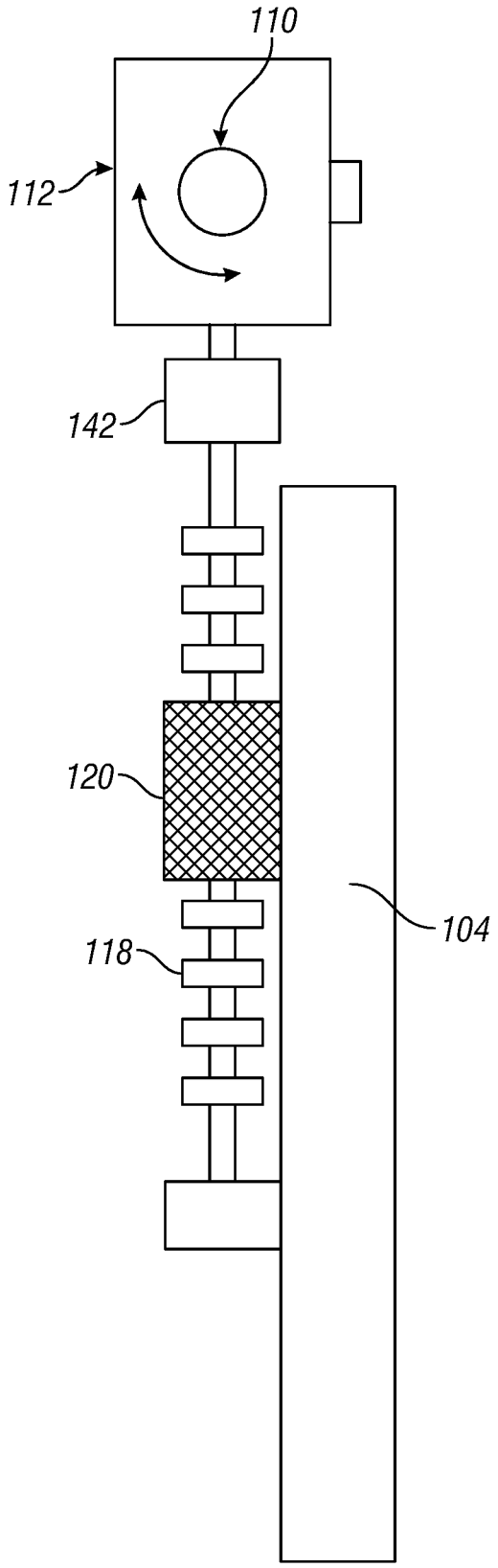
FIG. 8 illustrates a third example of a rotational force limiter.

FIG. 8 illustrates a third example of a rotational force limiter. In certain embodiments, torque limiter 142 may be applied within gearbox 112 or between gearbox 112 and threaded shaft 1118 used to translate the rotational movement into longitudinal movement. Torque limiter 142 may be any suitable torque limiter, including any of a variety of slip clutches.

Figure 9A:
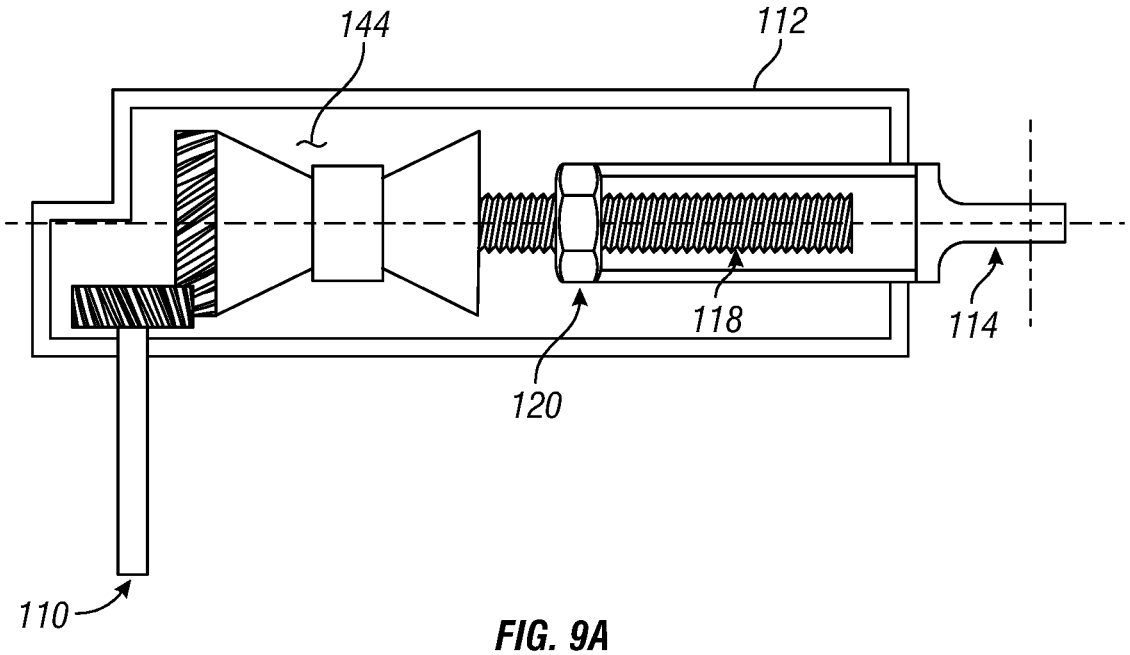
FIGS. 9A and 9B illustrate a longitudinal door system including a continuously variable gear box.
Figure 9B:
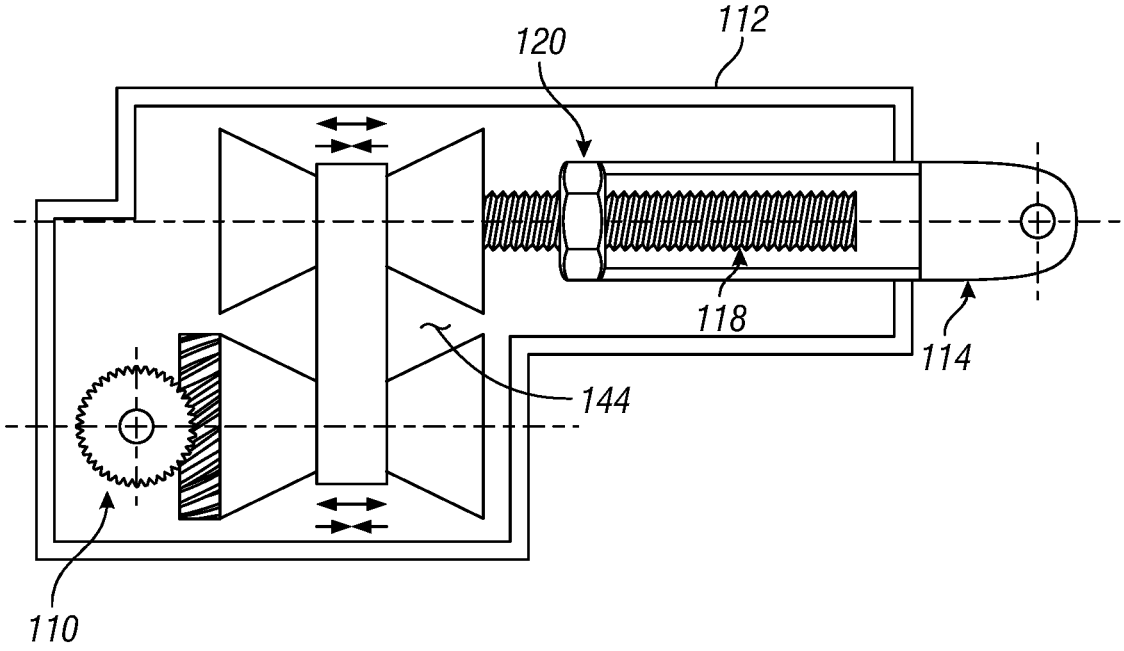

FIGS. 9A and 9B illustrate illustrates a longitudinal door system including a continuously variable gearbox. In certain embodiments, continuously variable gearbox 112 includes continuously variable transmission 144 coupled between rotating shaft 110 and threaded shaft 118. As the torque resistance of the system increases dramatically, such as when the longitudinal door system stops in the fully open or fully closed positions, continuously variable transmission 144 can shift the gear ratios such that the torque being transmitted by threaded shaft 118 reduces to zero. In this manner, the torque can be stepped down to limit over driving the longitudinal beam via threaded shaft 118.

Additionally, in some embodiments, the use of high speed capstan drives may be accommodated by adjusting the gear ratio at continuously variable transmission 144, thereby controlling the door opening speed or limit thereof. Similarly, for low speed capstan drives, the ratio can be changed to increase door opening speeds.

Figure 10:
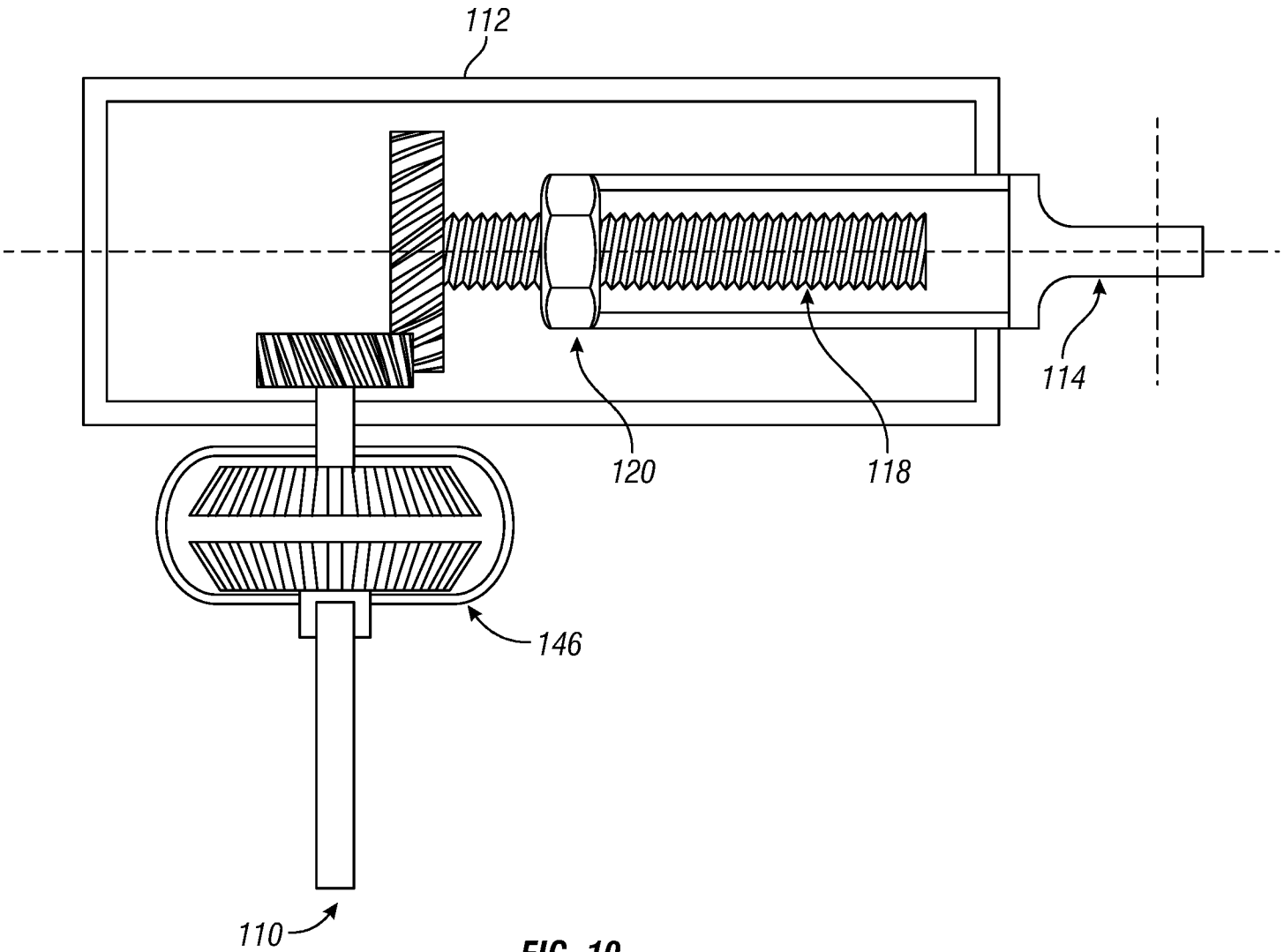
FIG. 10 illustrates a further example of a rotational force limiter.

FIG. 10 illustrates a further example of a rotational force limiter. In certain embodiments, torque convertor 146 may be installed between the capstan drive (e.g., rotating shaft 110) and threaded shaft 118.

In some embodiments, torque convertor 146 does not have a mechanical connection coupling each side, but can transmit force and direction through a fluid, such as a gas or liquid. Any suitable fluid of a variety of fluids can be used, including certain oils and air.

When the longitudinal door system is fully opened or closed, the threaded rod-side shaft of the torque convertor experiences increased resistance to motion (e.g., the longitudinal beam resting against a door beam stop) and the other side of the torque convertor simply spins within the fluid. Likewise, when the resistance of the door system is below a pre-determined level, torque convertor 146 transmits motion and force, thereby allowing the translation of the longitudinal beam to open and/or close the longitudinal doors.

As described above, capstan drives are available from multiple manufacturers with different rotational speed capabilities. These speeds can vary from as low as 4 rpm to as high as 1400 rpm. In certain embodiments, a gearbox is used to translate the rotational speed of the capstan drive to a desired speed of the threaded rod, and thus the opening and closing speed of the longitudinal door system.

Figure 11:
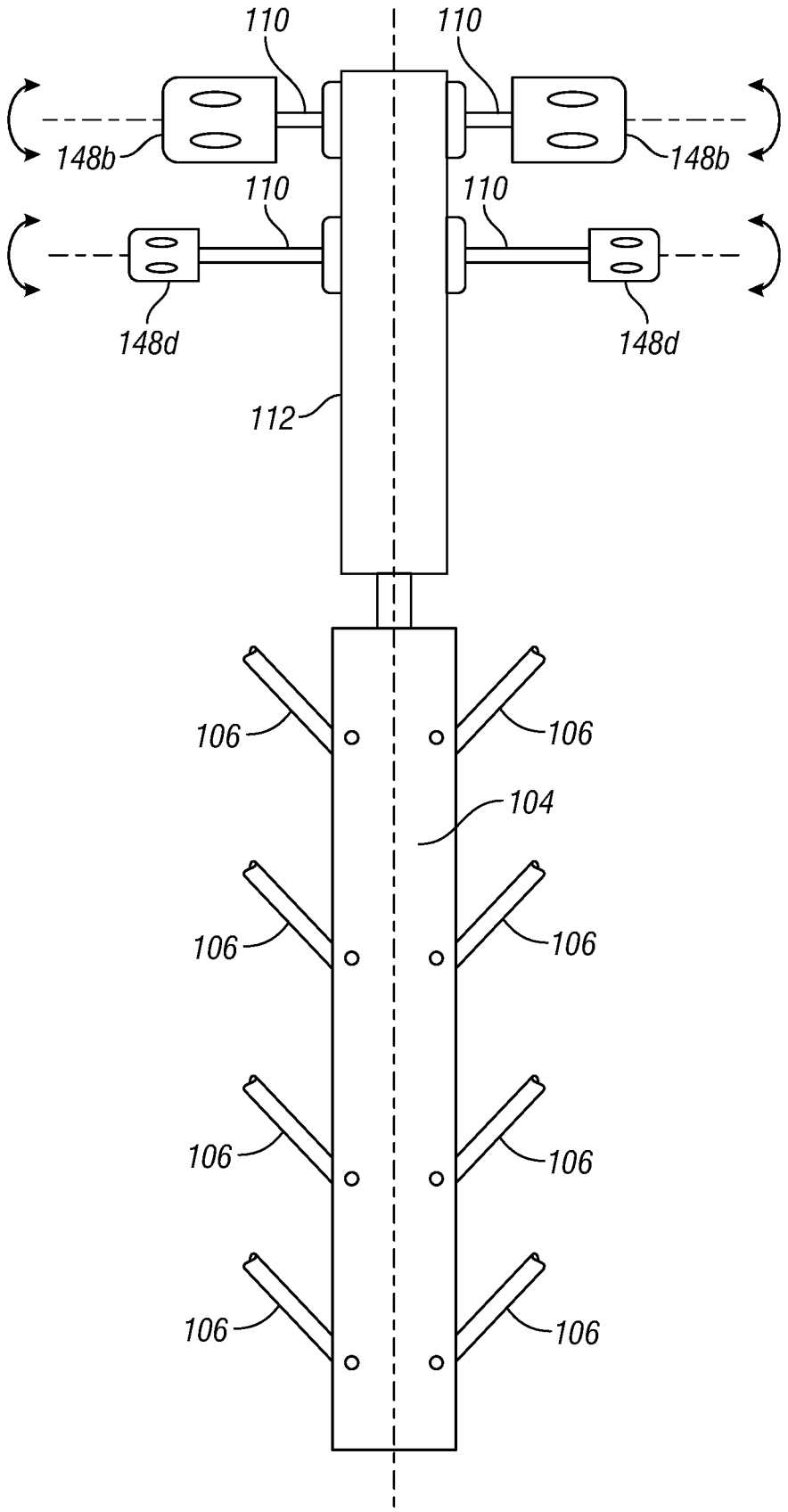
FIG. 11 illustrates an example longitudinal door system that includes multiple capstan drive engagement ports.

FIG. 11 illustrates an example longitudinal door system that includes multiple capstan drive engagement ports. In particular embodiments, multiple ports 148 may facilitate different types or categories of engagement mechanisms to drive the capstan mechanism. For example, one port may be provided with a first gear ratio to provide the desired threaded shaft rotational speed for a capstan drive with a first design speed. Another port may be provided with a second gear ratio for a capstan drive with a different design speed.

In the illustrated example, four ports 148, two on each side of the railcar, may be configured to receive two different capstan drivers, port 148*a* configured for providing rotation at a low speed and port 148*b* for providing rotation at a higher speed. Accordingly, the longitudinal door system may accommodate a wide variety of capstan drives without drastically changing the operating characteristics of opening and closing the longitudinal doors (e.g., by over-speeding or over-torqueing the doors or any of the components in between the capstan drive and the doors).

In certain embodiment, the geometry of the longitudinal door system may be modified to reduce the forces required to open and close the doors. Similarly, the geometry of the longitudinal door system may be modified to change the speed required to open and close the doors.

Figure 12:
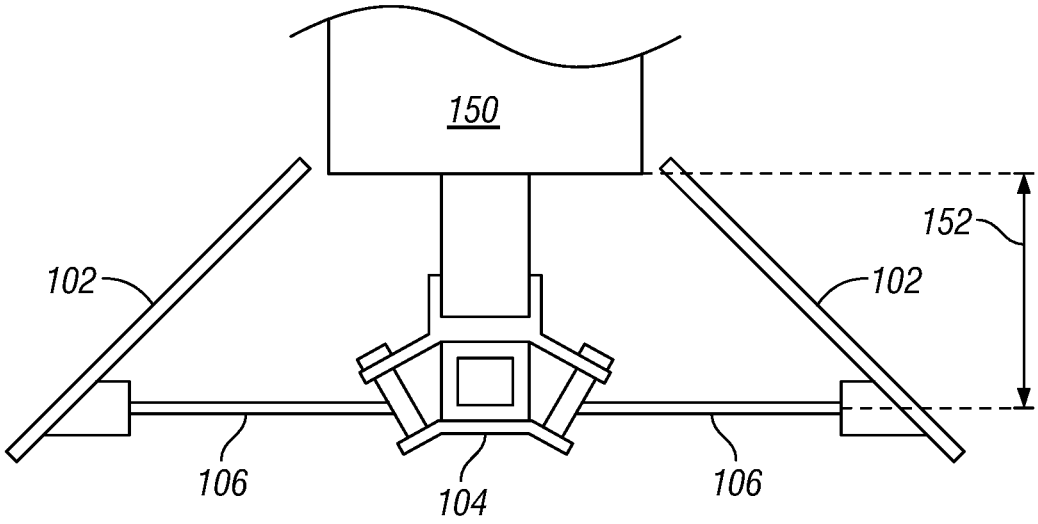
FIG. 12 illustrates two example configurations of the longitudinal door system.
Figure 12:
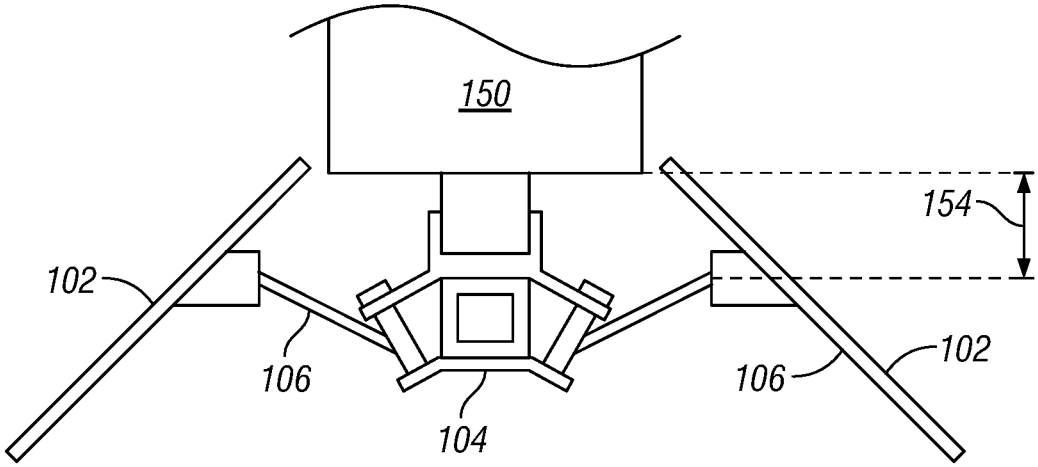

FIG. 12 illustrates two example configurations of the longitudinal door system. In particular, certain embodiments may have different strut lengths and attachment locations, which may result in the doors opening and closing more slowly or more quickly as desired. In some embodiments, for high speed capstan drives, one configuration may be used to slow the opening and closing of the doors. In other embodiments, for slower speed capstan drives, a second configuration may be used to speed up the opening and closing of the doors.

For example, in the top illustration of FIG. 12, longitudinal beam 104 is positioned further away from center sill 150 and uses longer struts to connect to doors 102 than the configuring in the bottom illustration. The top configuration results in a long stroke 152 that uses more torque and less speed. The bottom configuration results in a short stroke 154 that uses less torque and more speed.

Figure 13:
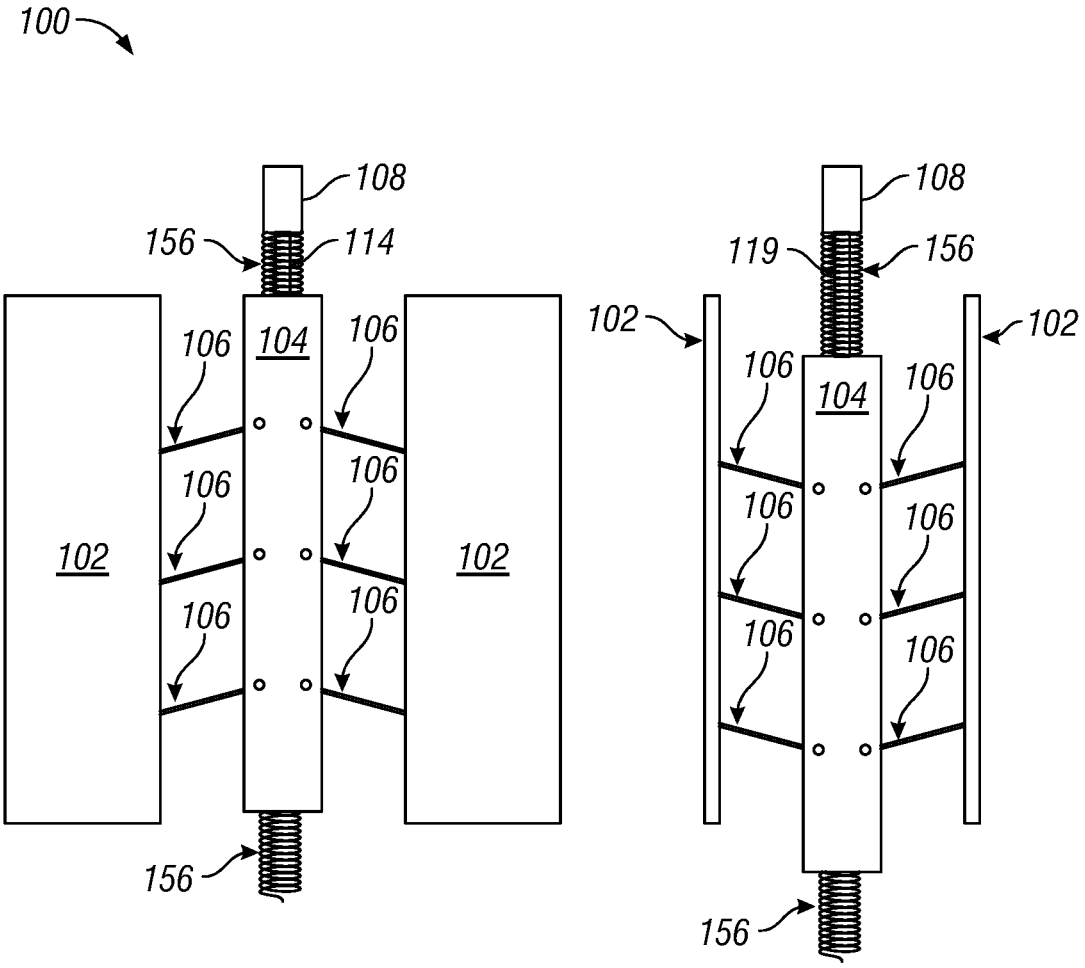
FIG. 13 illustrates a further example longitudinal door system including one or more spring or force dampening/restoring mechanisms.

FIG. 13 illustrates a further example longitudinal door system including one or more spring or force dampening/restoring mechanisms. In certain embodiments, large spring or dampener 156 may be applied near the ends of travel path of longitudinal beam 104 in both the opening and closing directions. Spring or dampener 156 may reduce the forces imparted to doors 102 and in-between components by providing a countering force to the translation of the longitudinal beam.

For example, a capstan drive may be used that has rotational speed that varies inversely with the torque demanded of the drive. In one particular example, the speed of the capstan drive may be 1400 rpm with a zero torque load but may rotate significantly slower when under the torque loading required to move the door system. Further, as the door approaches the fully open or closed positions, the longitudinal beam may engage spring or dampener 156, which increases the resistance to the capstan drive, thereby further slowing its motion (e.g., until stopped).

When the door system direction is reversed, spring or dampener 156 may disengage the longitudinal beam and reduce the resistance to the capstan drive. Similarly, spring or dampener 156 may be employed at the door closing point for the same purpose. In this manner, spring or dampener 156 may slow down the longitudinal beam (and coupled doors 102) as it approaches the fully open and/or closed positions, thereby reducing the potential for damaging collisions or over-torqueing within the longitudinal door system.

Capstan drives may also exhibit a torsional effect called torsional impact. As the resistance to rotational motion increases, the smoothness of the rotational speed may become more varied or exhibit impact-like forces. Accordingly, instead of a constant torque, the torque may vary significantly from a small value to a large value in a short period of time, usually on the order of fractions of a second. This type of motion can quickly overwhelm some types of mechanical torque limiters. For example, the maximum peak of the torque applied may exceed the torque limiter's capability, thereby allowing it to slip for a fraction of a second. This may allow the capstan drive's speed to increase and the supplied torque from the capstan drive to decrease below the torque limiter's capability, re-engaging the torque limiter. As the torque limiter re-engages, the capstan drive's speed decreases and its supplied torque increases and it may exceed the torque limiter's capability again. As a result, the system may experience a cycling between these conditions that is not desirable.

In certain embodiments, the longitudinal door system includes helical-cut gears, which may reduce the torque variability effects of the capstan drive. Additionally, as described above, certain embodiments allow the nut to disengage the threaded shaft at each end of travel, which can also limit the effects of capstan drive rotational variability. Another example is illustrated in FIG. 14.

Figure 14:
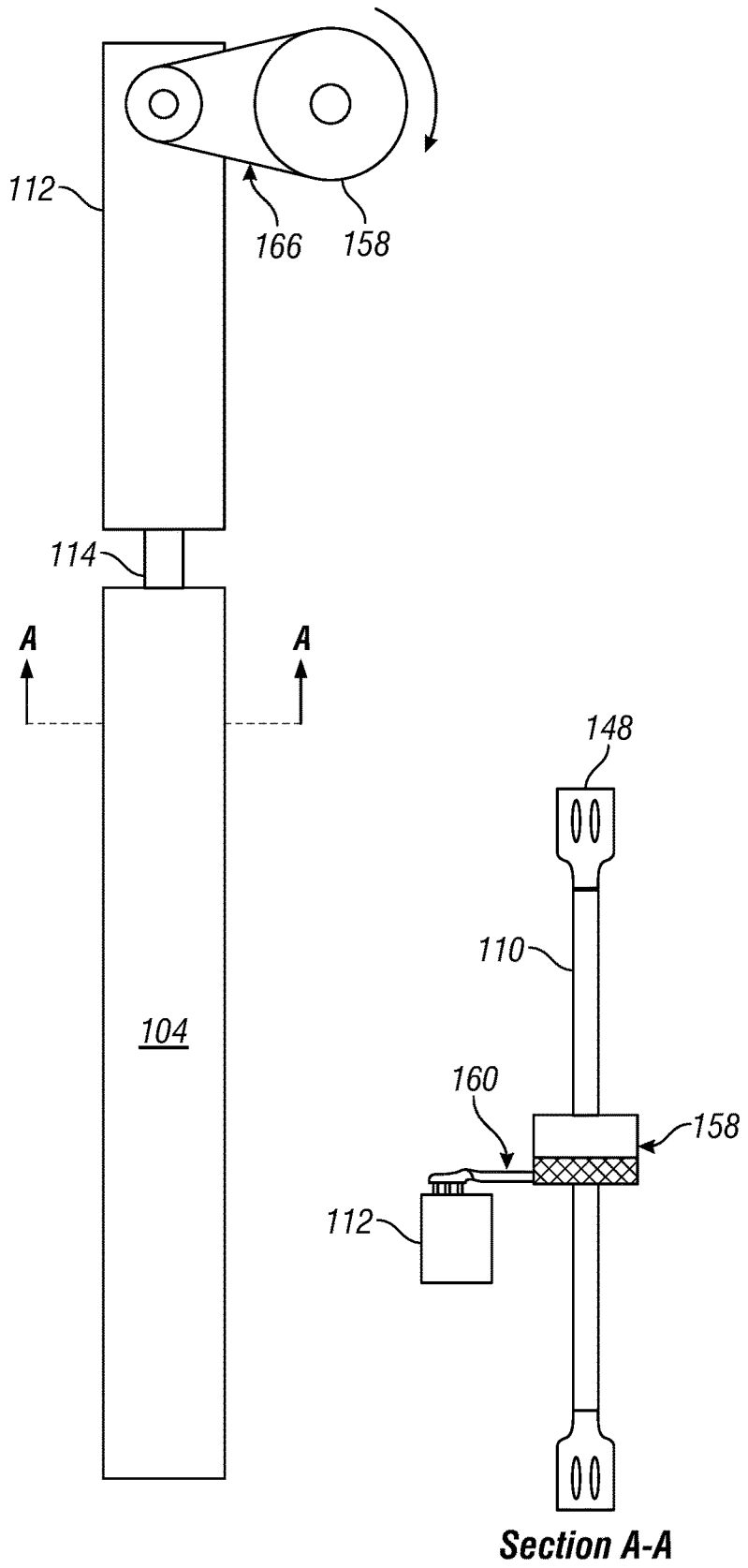
FIG. 14 illustrates another example longitudinal door system including a torsional dampener.

FIG. 14 illustrates another example longitudinal door system including a torsional dampener. In certain embodiments, a torsional dampener 158 may be employed in the system to reduce torsional variation from the capstan drive. As shown in the illustrated example, torsional dampener (or damper) 158 may be coupled to gearbox 112 via linkage or chain 160. Gearbox 112 may translate a torsional input (e.g., from threaded shaft 118 and nut 120) to torsional dampener 158. As a result, the rotational shocks or high peaks or valleys may be smoothed out.

In particular, Section A-A illustrates linkage or chain 160 coupling gearbox 112 (and thus threaded shaft 118 and nut 120) to rotating shaft 110 driven by the capstan input through torsional dampener 158. Accordingly, when the applied torque is smooth or otherwise within the normal variation, linkage or chain 160 may translate the rotation of rotational shaft 110 to gearbox 112. If, however, the torque exhibits a high spike, the spike may be absorbed via torsional dampener 158 and a smoothed-out torque is translated to gearbox 112. In this manner, such torque shocks may be limited, thereby reducing potential damage to the longitudinal door system.

Additionally, in certain embodiments, a torque convertor may be employed in the system to smooth out capstan drive speed and torque variability. For example, the torque convertor described in reference to FIG. 10 may provide similar functionality and protection to the torsional dampener in certain circumstances.

Additional operating considerations may be accommodated into a longitudinal door system. For example, when one considers the operation of the longitudinal door system in actual working conditions, the doors are typically opened while the weight of the commodity in the railcar is pressing down on the doors.

Accordingly, once the doors begin opening, the force on the door system to move in the opening direction may be augmented by the force of the commodity on the door, which may exceed the force supplied by only the capstan drive system. The excess force may result in a pulling force on the nut on the threaded shaft in the opening direction rather than a pushing force from the nut to the door system. This may be referred to as an over-running condition. With the commodity pulling the nut and the capstan trying to push the nut, the system's linear speed could become excessive or exceed a predetermined limit.

In certain embodiments, the capstan drive is connected to the threaded shaft via a worm gear drive, e.g., as illustrated in FIG. 3. This may help prevent the over-running condition by preventing the speeding up of the capstan drive's rotational speed. In other embodiments, a self-locking thread is provided on the threaded shaft-to-nut and threaded shaft-to-gearbox interfaces, which can reduce or prevent over-running.

Additionally, the self-locking thread may further allow the longitudinal door system to be stopped anywhere in its range of travel when desired (e.g., by stopping the capstan driving mechanism). In particular, the door may be maintained only partially open indefinitely, even with significant commodity weight pushing down on the doors, by stopping the capstan drive system. This may provide the additional benefit of controlling the speed of discharge of the commodity. For example, when the take away speed of the discharged commodity is not sufficient to keep up with a fully opened door discharge rate, and a partially opened door will help keep from excessive spillage of the commodity.

In certain embodiments, a centrifugal clutch may be employed in the capstan drive system to limit excessive speed and direction. An example is illustrated in FIG. 15.

Figure 15:
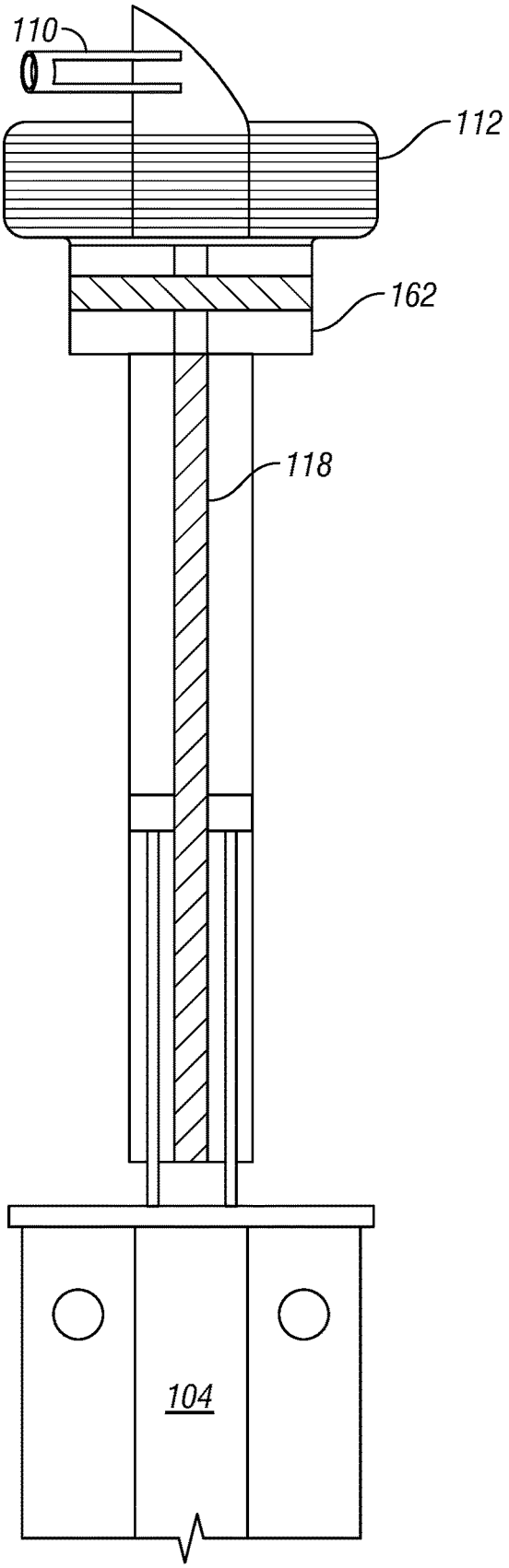
FIG. 15 illustrates an example longitudinal door system with a centrifugal clutch.

FIG. 15 illustrates an example longitudinal door system with a centrifugal clutch. For example, centrifugal clutch 162 coupled between gearbox 112 and threaded shaft 118 may be controlled to change the slippage between gearbox 112 and threaded shaft 118 to limit the rotational speed. In this manner, the speed of the door opening and closing operation may be controlled using a clutch.

Figure 16:
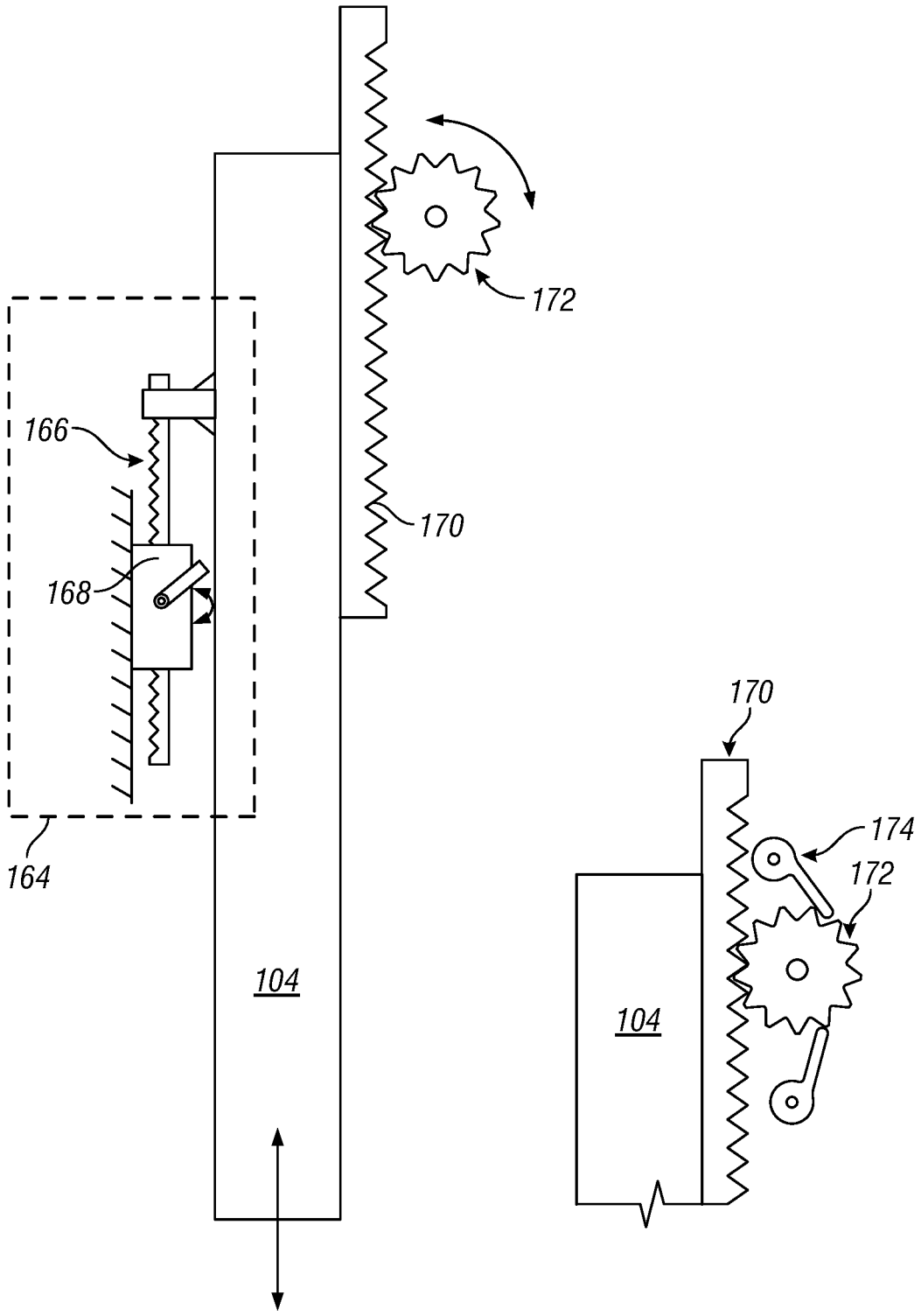
FIG. 16 illustrates another example of a longitudinal door system implemented with a ratcheting system.

FIG. 16 illustrates another example of a longitudinal door system implemented with a ratcheting system. In certain embodiments, a ratchet or cog system 164 may be employed to permit movement of longitudinal beam 104 only in the desired direction. Ratchet or cog system may include stationary components 166 coupled to longitudinal beam 104 and a ratcheting mechanism 168 coupled to the railcar. In other embodiments, the stationary components may be coupled to the railcar and the ratcheting mechanism may be coupled to longitudinal beam 104. If the over-running condition occurs during the opening of the doors, ratcheting or cog system 164 may limit the speed at which the capstan drive system can operate.

In some embodiments, the longitudinal door system may include rack gear 170 and pinion gear 172 that couple the rotating shaft (via pinion gear 172) to the longitudinal beam (via rack gear 170). The ratcheting mechanism may be also coupled to the longitudinal beam to control its speed. For example, one or more ratchet mechanism 174 may be coupled to pinion gear 172 as illustrated. In some embodiments, the ratchet mechanism comprises a pawl.

In some embodiments, the system will need the ability to switch directions to permit control of both the opening and closing speeds. For example, there may be two ratchet mechanism for each direction of opening and closing. Each of the ratchet mechanisms may be selectively engaged for its respective direction of travel (e.g., when the door is closing or opening).

An additional consideration is the lubrication of the gearbox and threaded shaft—nut system to ensure adequate performance and to meet design life goals. Lubrication may be required, but it may be further desired to ensure that the system remains leak-free throughout its lifetime. Accordingly, certain embodiments implement one or more seals to limit or prevent leaking of the lubrication. In certain embodiments, a non-metallic nut may be used on the threaded shaft, which may eliminate the need for additional lubrication. For example, the non-metallic nut may be "self-lubricating," thereby not requiring any additional lubrication to be applied between it and the threaded shaft.

Figure 17:
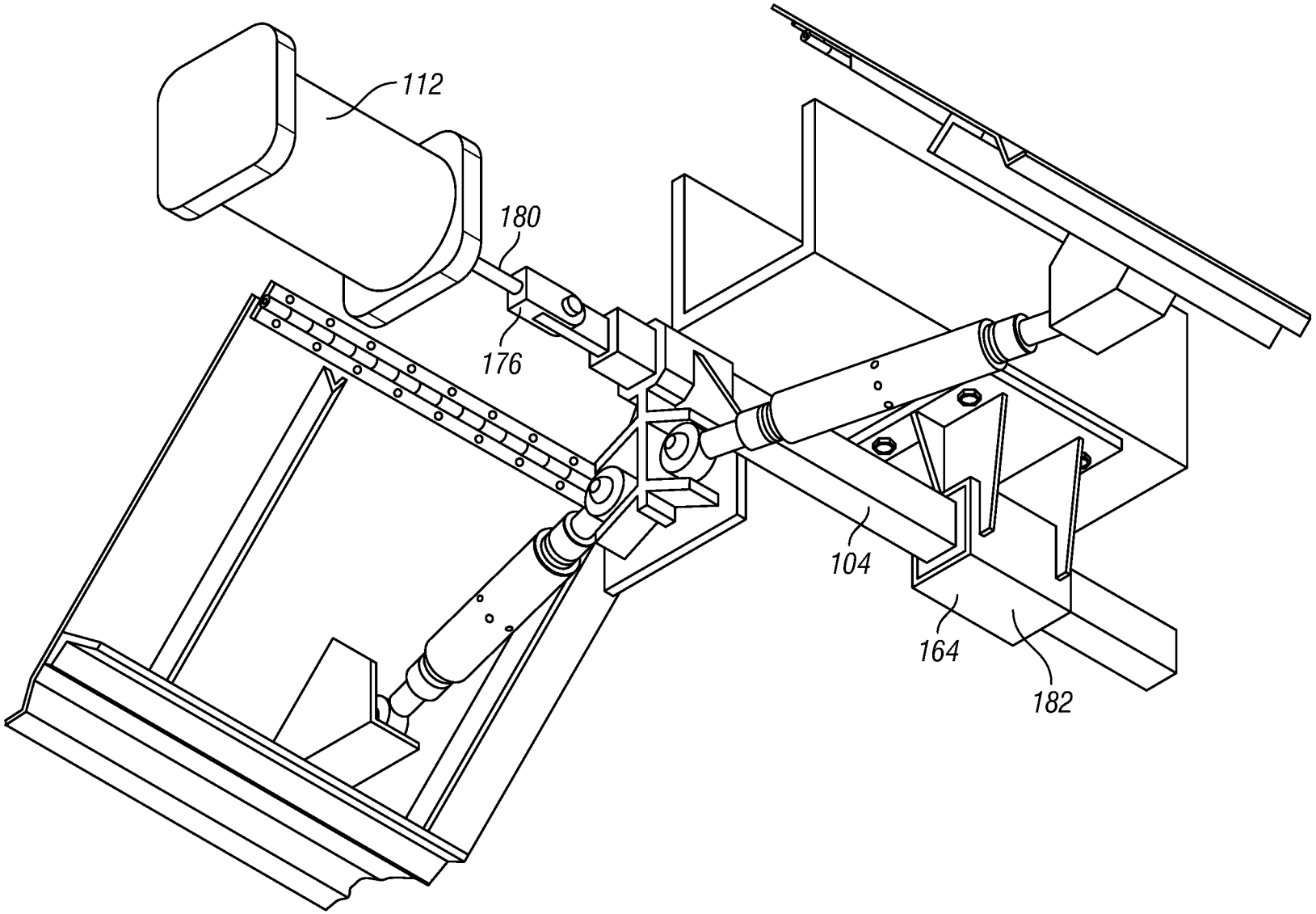
FIG. 17 illustrates an example configuration of a longitudinal operating beam within a longitudinal door system supported by a beam guide.

FIG. 17 illustrates an example configuration of a longitudinal operating beam within a longitudinal door system supported by a beam guide. The nut of the threaded shaft and nut mechanism of gearbox 112 may be attached to longitudinal beam 104 through rod 180 and clevis 176. However, as the threaded shaft is rotated by the capstan drive, the nut is kept from rotating by this connection. Further, when the nut is turning with respect to the threaded shaft, friction may occur and the higher the system forces, the higher the friction load becomes. Due to the connection between the nut and longitudinal beam 104, the friction may be transmitted to longitudinal beam 104 as a torque. The torque can be sufficient to unacceptably twist longitudinal beam 014, causing excessive wear in beam guides 182. Accordingly, in certain embodiments, additional beam supports, e.g., beam guides 182, may be employed, thereby increasing the stability of longitudinal beam 104 against such torsional forces and spreading out the torsional forces across additional beam supports 182.

Other modifications or configurations may further improve the torsional deflection. For example, in certain embodiments, the longitudinal beam 104 cross-section may be modified to reduce the amount of torsional deflection. In certain other embodiments, the rod between the nut and the beam clevis may be of a shape such that the friction torsion is resisted by the housing of the rod.

Figure 18:
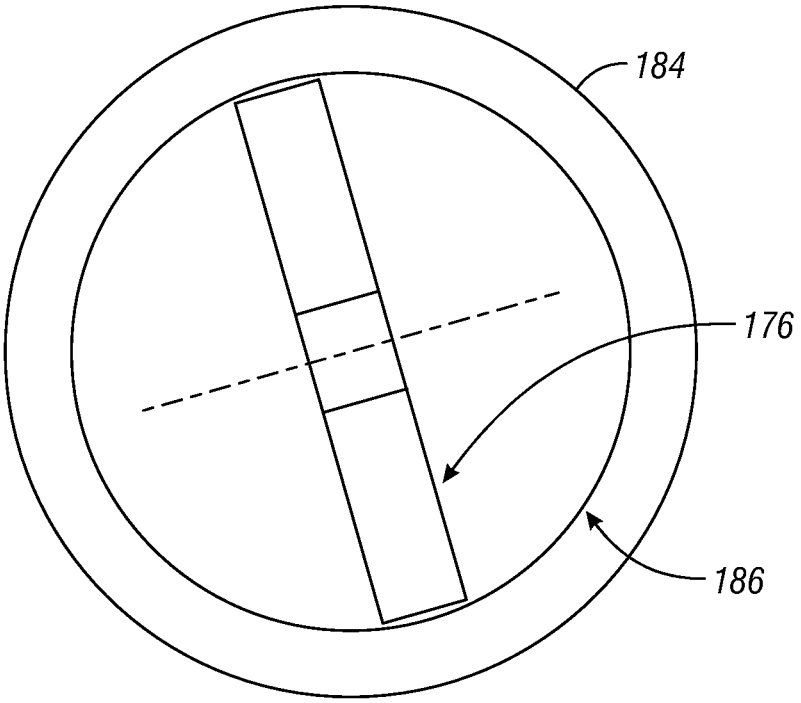
FIG. 18 illustrates two example configurations of the clevis within the housing.
Figure 18:
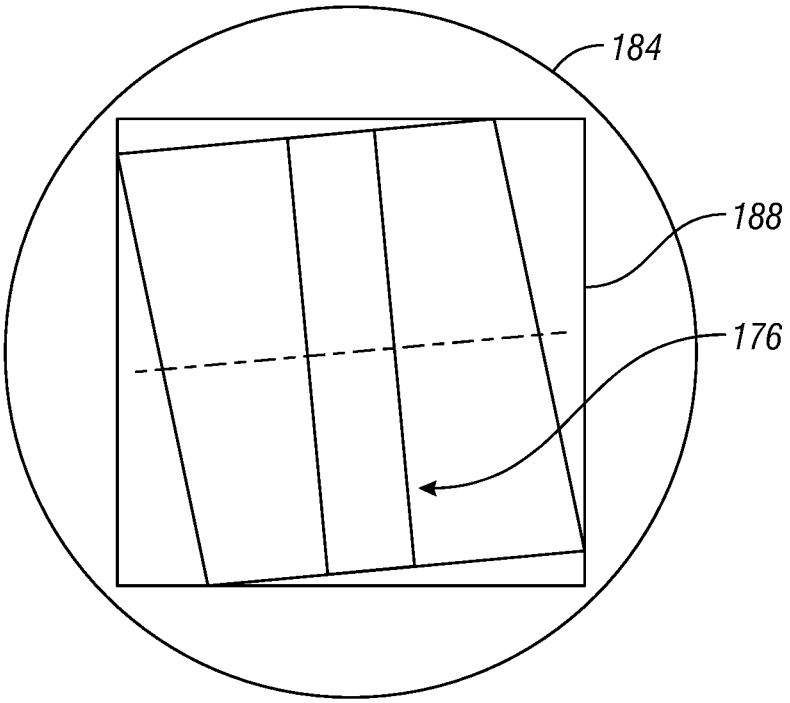

FIG. 18 illustrates two example configurations of the clevis within the housing. The top configuration illustrates housing 184 with round opening 186 in the housing. In this configuration, clevis 176 is able to rotate within housing 184, thereby allowing the transmission of torsion to the longitudinal beam 104.

In the bottom configuration, however, the rod attached between the nut and clevis 176 is a square shape and the opening in the end of housing 184 that the rod extends from is square opening 188. In this example configuration, the rod will only rotate a certain amount before bottoming out on housing 184 and therefore, not transmit significant torsion to the beam. Accordingly, one or more configurations of the coupling mechanism between longitudinal beam 104 and the translational force may limit the impacts of inadvertent torque applied to longitudinal beam 104.

Security of Capstan Drive Mechanism Embodiments

Industry rules and standards may require that railcar gates and doors be secured with security seals. This can prevent vandalism and provide a visual security check that the gates and doors are closed and secured. Additionally, door operation must be permitted from either side of the railcar and therefore security seals are required on both sides of the railcar.

In certain embodiments, a security seal may be installed at the engagement point of each capstan drive to the railcar drive system. An example is illustrated in FIG. 19.

Figure 19:
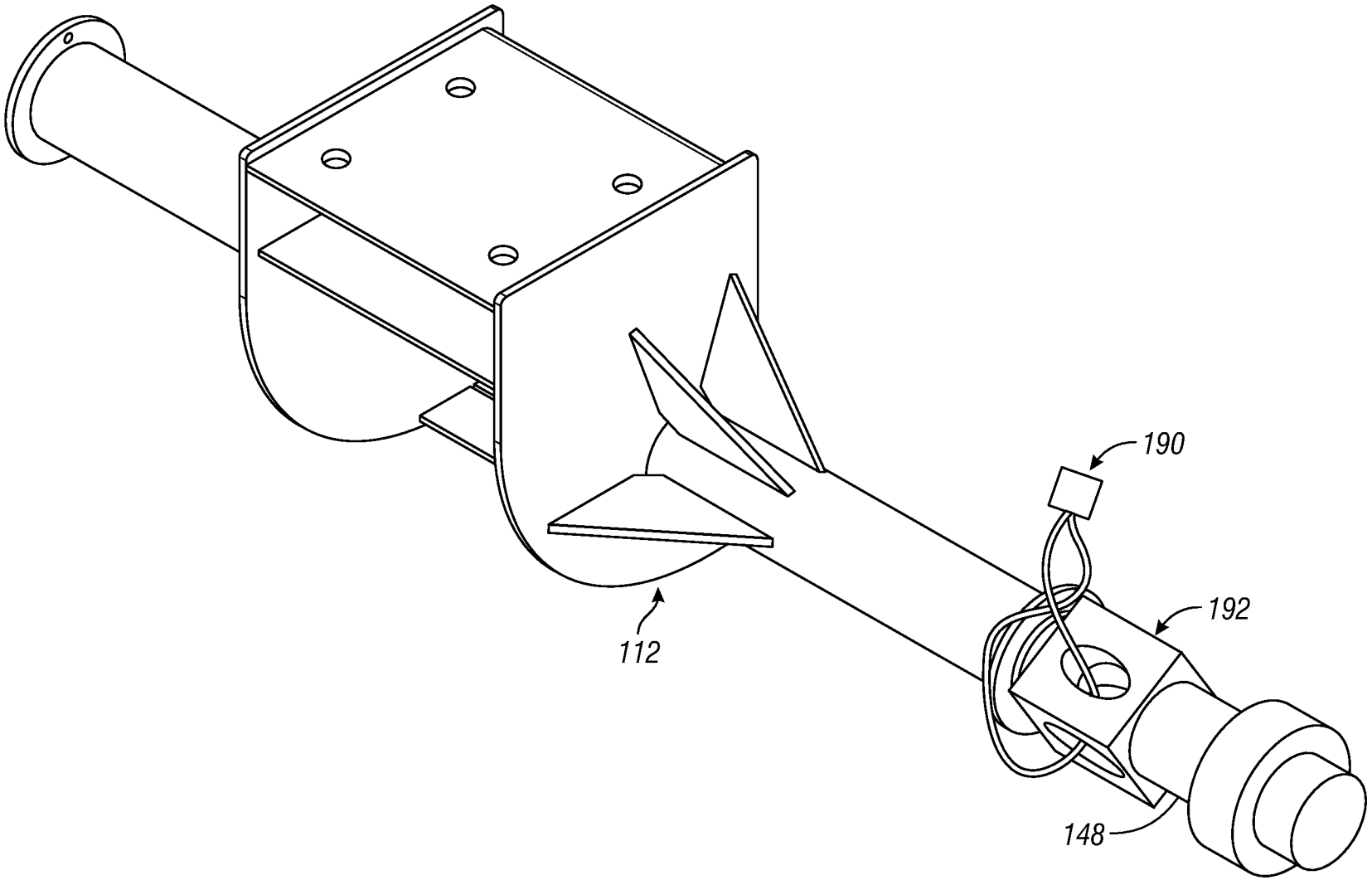
FIG. 19 illustrates an example security apparatus for securing an engagement port of a capstan drive.

FIG. 19 illustrates an example security apparatus for securing an engagement port of a capstan drive. In particular, capstan drive receptacle 148 is coupled to capstan gearbox 112 and secured with security seal 190. When the loaded railcar is to be unloaded, security seal 190 is removed, the capstan drive engaged, and the doors are opened to discharge the commodity. When empty, the capstan drive is used to close the doors and a new security seal 190 is installed.

In some embodiments, capstan drive receptacles 148 are located on both sides of the railcar because there is no guarantee which direction the railcar will be facing when it needs to be unloaded and no guarantee which side of the railcar the capstan drive will be located with respect to the direction of railcar travel. In some embodiments, security seal 190 on the opposite side of the railcar is not disturbed when security seal 190 is removed and the capstan drive engaged. However, this gives no visual indication on one side of the railcar whether the door has been operated and the railcar car re-sealed. This could falsely indicate that the doors have been closed and sealed the entire time, when in fact they may have been left open or opened to remove commodity and then closed.

In certain embodiments, security seal 190 on an opposite side of the railcar may be sheared off when the capstan drive on one side has its security seal 190 removed and capstan drive operated. In this manner, when railcar operations are completed and the doors are closed, new security seals 190 are installed on both sides of the railcar, even if only one side was used to operate a capstan drive. Further, if only one security seal 190 is replaced, then the lack of security seal 190 on the opposite side of the railcar may indicate an unsecure railcar, the condition of which may be addressed at the next stopping point.

As in the illustrated example shown in FIG. 19, security seals 190 may be installed through the capstan receptacle shafts 192 on both sides of the railcar. Capstan receptacle shafts 192 may be connected to each other in gearbox 112 or another method such that rotation on one side will rotate capstan receptacle shaft 192 on the other side of the railcar. When security seal 190 on one side of the railcar is removed and the capstan drive operated, security seal 190 on the opposite side of the railcar is sheared due to the motion of capstan drive receptacle 148. As a result, an indication on both sides of the railcar is provided that the door has been opened. It does require, however, the installation of new security seals 190 on both sides of the railcar to ensure that the door has been closed after use. This may prove difficult in certain circumstances, e.g., by requiring the installer to cross the tracks to install the seal on one side, for which a crossing point may not be easily ascertainable.

Figure 20:
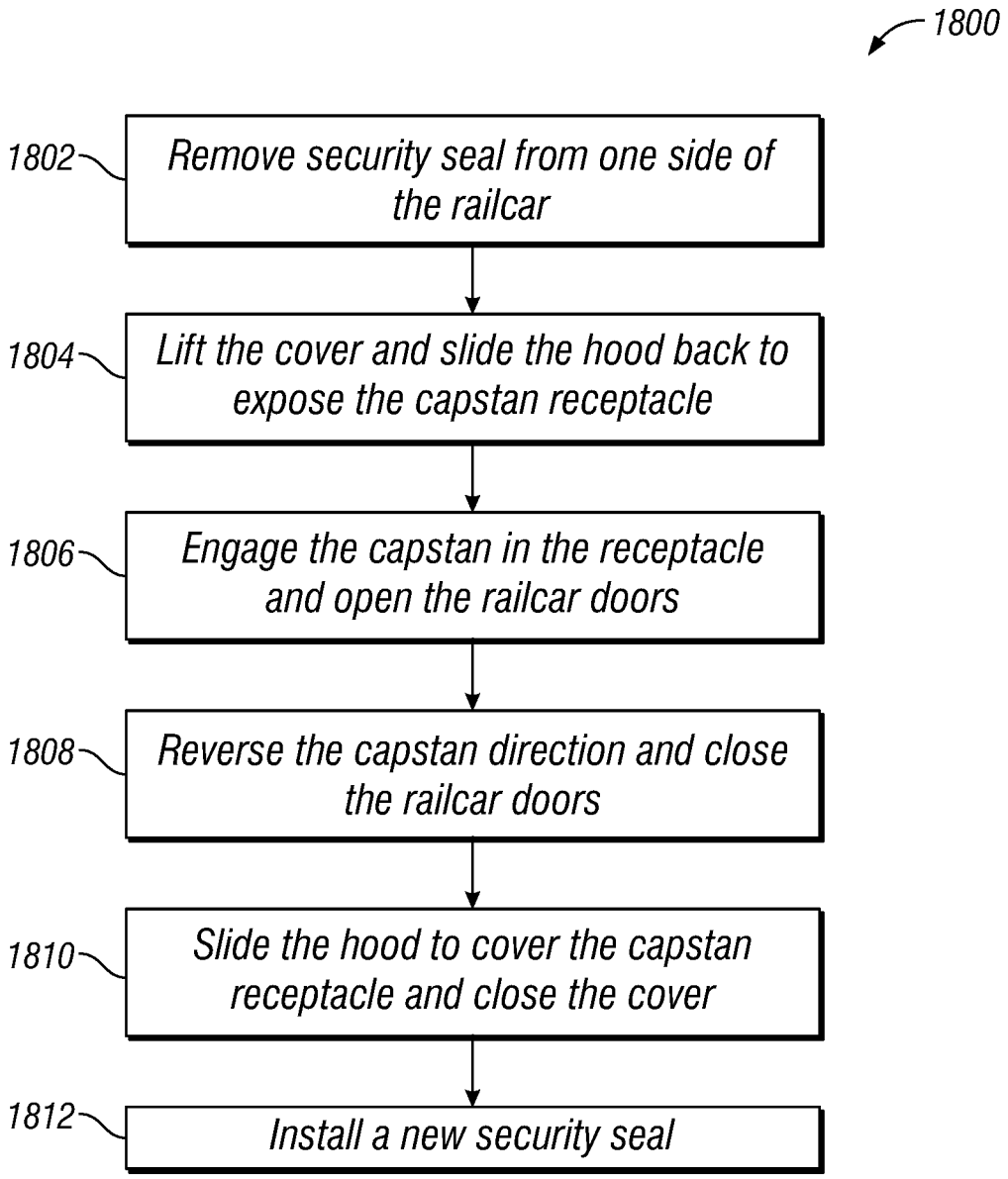
FIG. 20 illustrates an example method facilitating removal of a security seal from a first side of a railcar and giving indication on a second side without removing the security seal on the second side.

FIG. 20 illustrates an example method 1800 facilitating removal of a security seal from a first side of a railcar and giving indication on a second side without removing the security seal on the second side. Additionally, method 1800 may provide a method for preventing the installation of a new security seal unless the longitudinal door on the railcar is in the closed position. As a result, the security seal may be removed from only one of the sides of the railcar and visual confirmation that the longitudinal door is fully closed is provided on both sides of the railcar.

FIG. 20 illustrates an example flow chart diagram of a procedure for removing the security seal, operating the longitudinal doors open and closed, and installing a new security seal to replace the one previously removed. Method 1800 may be understood in reference to a configuration of the security mechanisms described in reference to FIGS. 21A and 21B, and FIGS. 22A and 22B, which are further detailed below.

The method may begin at step 1802 by removing the security seal (e.g., security seal 190) from one side of the railcar. After the security seal is removed, at step 1804 a cover (e.g., cover 196) may be lifted and a hood (e.g., hood 194) slid back to expose the capstan receptacle (e.g., capstan receptacle 148).

After the capstan receptacle is exposed, the capstan may be engaged through the receptacle and the doors of the longitudinal door system opened at step 1806. For example, the capstan drive may open the doors to allow cargo or a transported commodity to be offloaded at the current location of the railcar. After offloading is finished, the capstan drive may be operated in the reverse direction to close the railcar doors at step 1808.

With the doors fully closed, at step 1810 the hood (e.g., hood 194) may be slid back over the capstan receptacle (e.g., capstan receptacle 148) and the cover (e.g., cover 196) closed to conceal the capstan receptacle. At step 1812, a new security seal (e.g., security seal 190) may be installed on the cover, thereby securing the longitudinal door system by limiting access to the capstan receptacle.

Figure 21A:
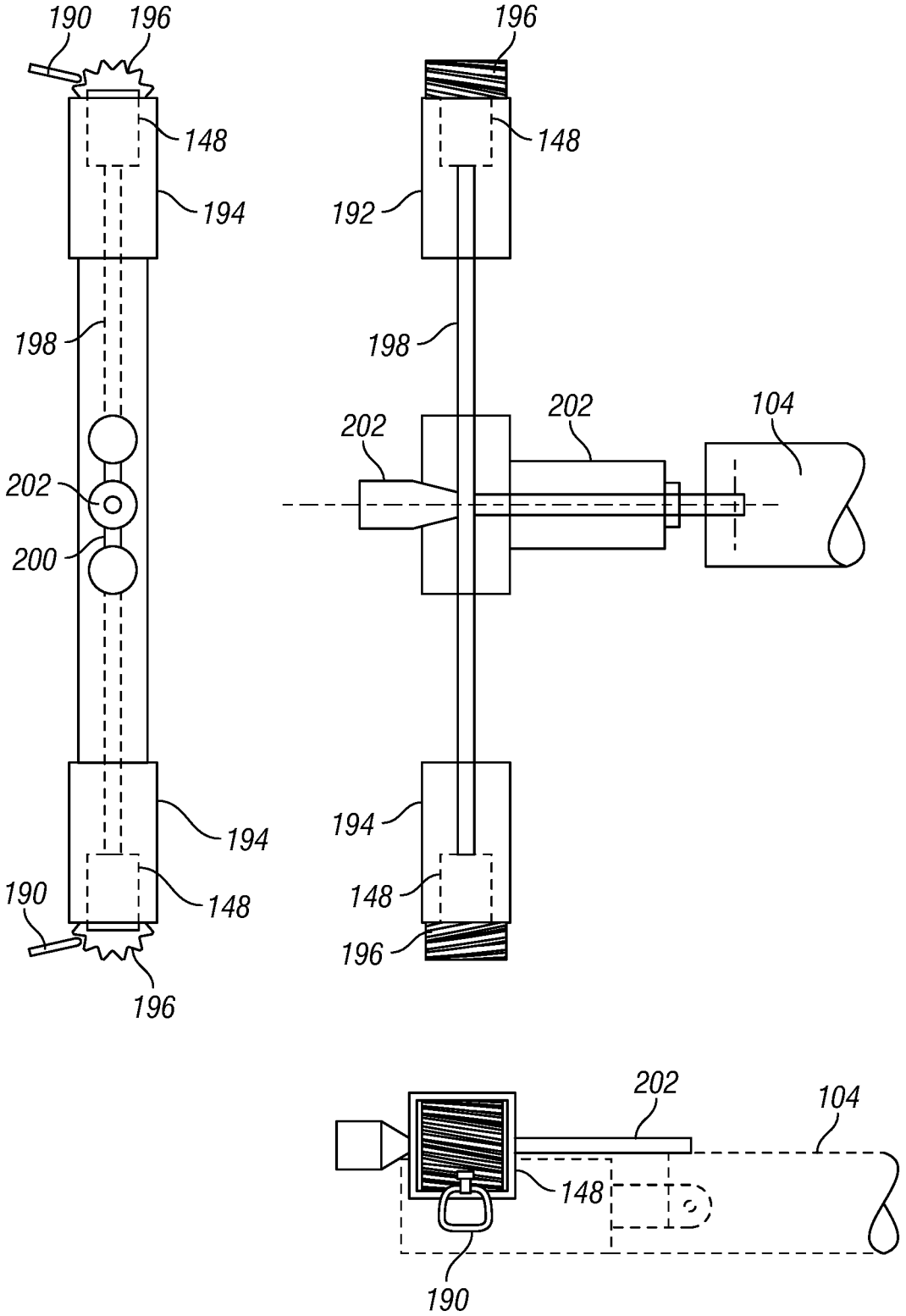
FIGS. 21A and 21B illustrate an end view, top view, and side view of a portion of the security seal mechanism with portions of the longitudinal door system in two conditions, respectively, in accordance with certain embodiments.
Figure 21B:
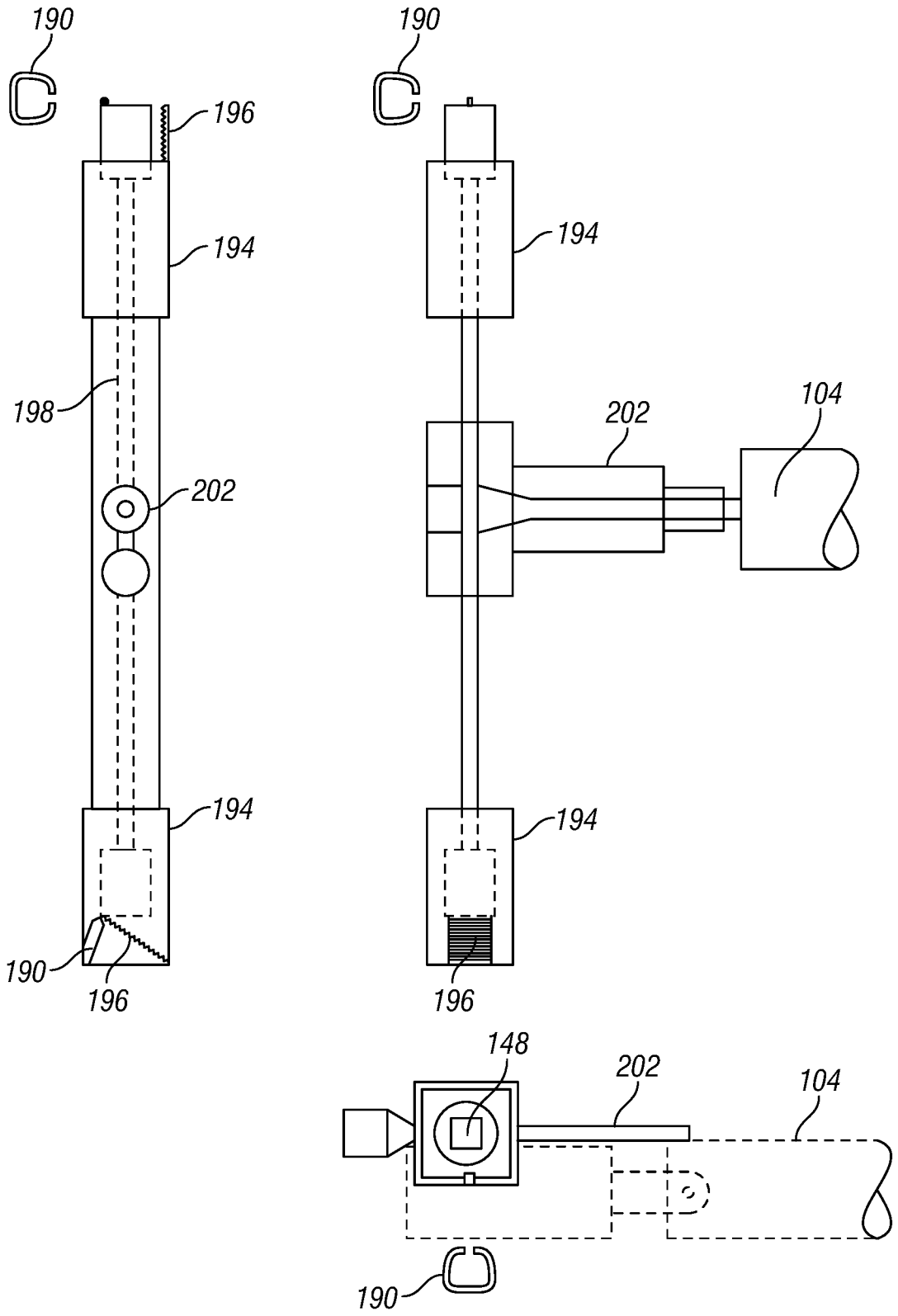

FIGS. 21A and 21B show the end view, top view, and side view of a portion of the security seal mechanism with portions of the longitudinal door system in two conditions, respectively, in accordance with certain embodiments. Capstan drive receptacles 148 may be located on both sides of the railcar and are enclosed on each side by hood 194. The end of each hood 194 includes cover 196 that may be flexible in length, such as an accordion-style design. Although this particular configuration is described herein, other designs are contemplated that allow cover 196 to flex in the required positions.

The two hoods 194, one on each side of the railcar, may be attached with bar member 198 that ensures that two hoods 194 move laterally together with respect to the railcar. Bar member 198 may be constructed of any of a variety of materials and may one of a variety of shapes and cross-sections.

In some embodiments, bar member 198 has slot 200 of varying widths that permits control rod 202 to pass through it. When the doors are closed, the narrow portion of control rod 202 (e.g., coupled to longitudinal beam 104) passes through the narrow portion of slot 200 which allows hoods 194 to be moved laterally with respect to the railcar. When the doors are opened or not fully closed, the wide portion of control rod 202 passes through bar member 198 preventing hoods 194 from being centered on the railcar, which prevents installation of security seal 190.

Control rod 202 may be attached to the longitudinal door system such that it moves in a longitudinal direction in conjunction with and in the same direction as longitudinal beam 104. When the doors are closed (e.g., FIG. 21A), the narrow portion of control rod 202 passes through slot 200 in bar 198 and when the doors are open (e.g., FIG. 21B), control rod 202 is pulled until the wide portion of control rod 202 passes through bar 198. In this way, hoods 194 cannot be slid and centered to attach the security seal unless the longitudinal doors are fully closed.

Figure 22A:
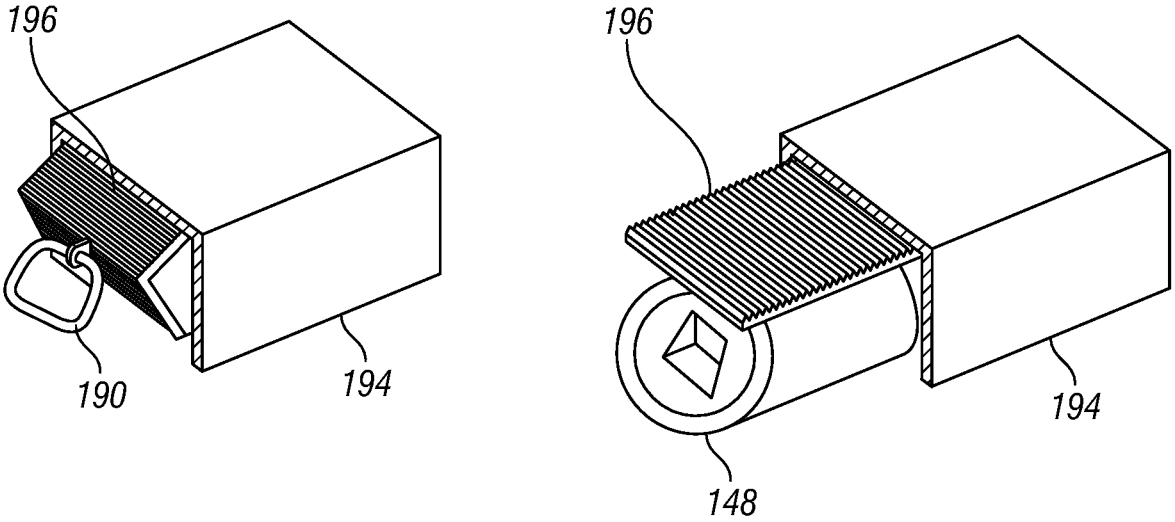
FIGS. 22A and 22B illustrate example security and concealment of a capstan receptacle in certain positions, in accordance with certain embodiments.
Figure 22B:
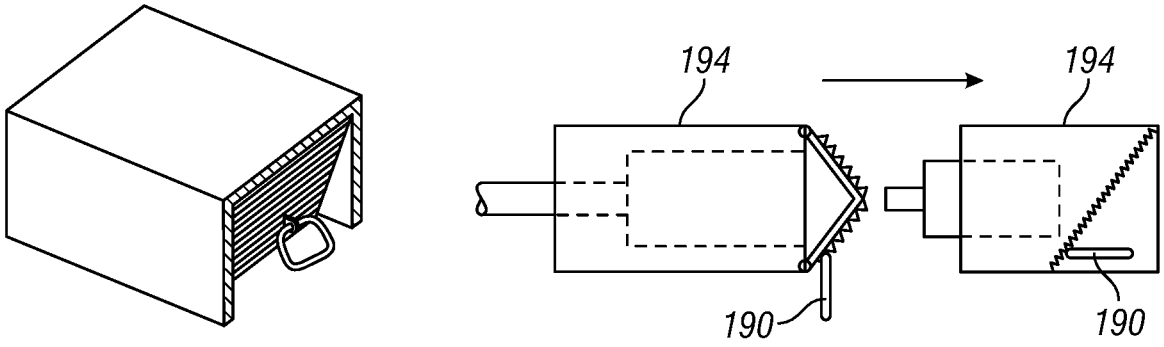

In certain embodiments, the security seal is attached to a lug through the cover to the capstan receptacle on both sides of the railcar. FIGS. 22A and 22B illustrate example security and concealment of a capstan receptacle in certain positions, in accordance with certain embodiments. For example, when it is desired to open the railcar longitudinal door, security seal 190 may be removed from a first side of the railcar and cover 196 is rotated up and hood 194 is slid toward the center of the railcar, as shown in FIG. 22A. This may expose capstan receptacle 148 for the capstan drive, which may be engaged and operated to open the longitudinal doors. As the doors are opened, longitudinal beam 104 moves in a longitudinal direction and moves control rod 202. As control rod 202 moves, the wide part of control rod 202 engages bar 198 between two hoods 194 in the wide part of slot 200. This prevents hoods 194 from being closed unless the door has been moved back to the closed position.

In certain embodiments, the motion of hood 194 to expose capstan receptacle 148 also causes hood 194 on the opposite side of the railcar to cover up its security seal 190, e.g., as shown in FIG. 22B. As result, the hidden security seal 190 provides an indication to a person on the second side of the railcar that the railcar is in an unsecured condition and even that the longitudinal doors are open. If, however, when the commodity has been discharged from the railcar, the capstan drive is used to close the longitudinal door, then longitudinal beam 104 moves control rod 202 such that the narrow portion passes through bar 198 between two hoods 194. When the door is fully closed, the capstan drive may be disengaged from capstan receptacle 148 and hood 194 is slid back into position. Thus, once hood 194 is slid back into position, cover 196 may be closed over capstan receptacle 148 and a new security seal 190 is installed.

In certain embodiments, the motion of hoods 194 on opposite sides of the railcar are coupled together. Accordingly, security seal 190 on the opposite side of the railcar may be re-exposed, thereby providing an indicator that the railcar is in a secure condition, without having to break the security on the opposite side to operate longitudinal door system.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

The invention claimed is:

1. A longitudinal door system, comprising:

one or more longitudinal doors for a railcar;

a longitudinal operating beam coupled to the one or more longitudinal doors via one or more struts, wherein a translation of the longitudinal operating beam is coupled to an opening and closing of the one or more longitudinal doors; and a gearbox coupled to the longitudinal operating beam and a first capstan receptacle, the gearbox operable to translate a rotational movement of the first capstan receptacle to a linear movement of the longitudinal operating beam;

a second capstan receptacle coupled to the gearbox, wherein the first capstan receptacle extends toward a first side of the railcar, and the second capstan receptacle extends toward a second side of the railcar; and a security system comprising a first security seal for the first capstan receptacle and a second security seal for the second capstan receptacle, wherein the first and second security seals are configured to indicate whether the first and second capstan receptacles have been accessed since installation of the first or second security seal.

2. The longitudinal door system of claim 1, wherein the gearbox is coupled to the longitudinal operating beam via:

a threaded shaft coupled to the rotation provided by the first capstan receptacle; and a nut disposed on the threaded shaft and coupled to the longitudinal operating beam, wherein the nut is configured to move along the threaded shaft as the threaded shaft rotates and causes movement of the longitudinal operating beam in the direction of the movement of the nut.

3. The longitudinal door system of claim 2, further comprising a re-engaging spring disposed at a first end of the threaded shaft, wherein the re-engaging spring provides a restorative force to the nut in a first direction when the threaded shaft does not rotate or rotates in a first direction.

4. The longitudinal door system of claim 3, further comprising a second re-engaging spring disposed at a second end of the threaded shaft, wherein the re-engaging spring provides a restorative force to the nut in a second direction when the threaded shaft does not rotate or rotates in a second direction.

5. The longitudinal door system of claim 1, further comprising a shearing pin disposed between the gearbox and the first capstan receptacle, wherein the shear pin is configured to shear and reduce or eliminate the coupling between the gearbox and the first capstan receptable in response to a torque exceeding a predetermined value.

6. The longitudinal door system of claim 1, further comprising a torque limiter disposed between the gearbox and the first capstan receptacle, wherein the torque limiter limits the torque translated from the first capstan receptacle to the gearbox.

7. The longitudinal door system of claim 1, wherein the gearbox is coupled to the longitudinal operating beam via one of a torque limiter, a continuously variable transmission, a centrifugal clutch, and a torque converter.

8. The longitudinal door system of claim 1, further comprising a second capstan receptacle, wherein the first capstan receptacle and the second capstan receptacle are coupled differently via the gearbox to the longitudinal operating beam.

9. The longitudinal door system of claim 1, further comprising a spring or damper at each end of the longitudinal operating beam, the spring or damper configured to provide a restorative force to the longitudinal operating beam moving in the direction towards the spring or dampening mechanism.

10. The longitudinal door system of claim 1, further comprising a torsional dampener coupled between the gearbox and the first capstan receptacle configured to dampen variations of torque received from a capstan drive.

11. The longitudinal door system of claim 1, wherein the gearbox is coupled to the longitudinal operating beam via:

a rack and pinion system; and a ratchet configured to control the movement or speed of the longitudinal operating beam in both directions of travel of the longitudinal operating beam.

12. The longitudinal door system of claim 1, wherein the gearbox is slidably coupled to the longitudinal operating beam.

13. The longitudinal door system of claim 1, wherein the gearbox is coupled to the longitudinal operating beam via a rod and clevis, wherein an end of the rod comprises a rod housing and the clevis is partially disposed within the rod housing and the rod housing is configured to reduce torsional flex imparted to the longitudinal operating beam.

14. The longitudinal door system of claim 1, wherein:

the first capstan receptacle is coupled to a first cover through which the first security seal is secured, and a first hood disposed over the first capstan receptacle;

the second capstan receptacle is coupled to a second cover through which the second security seal is secured, and a second hood disposed over the second capstan receptacle; and wherein the first hood is coupled to the second hood such that movement of the first hood results in movement of the second hood.

15. The longitudinal door system of claim 14, wherein the longitudinal operating beam is coupled to the first and second capstan receptacles via a control rod extending along a direction of movement of the longitudinal operating beam.

16. The longitudinal door system of claim 15, wherein the first security seal cannot be attached to the first cover and the first capstan receptacle unless the first hood and the first cover are in a closed position.

17. The longitudinal door system of claim 16, wherein the first hood cannot be closed when the longitudinal operating beam and the longitudinal doors are in an open position.

18. The longitudinal door system of claim 16, wherein the first security seal and the second security seal provide a visual indication when the one or more longitudinal doors of the railcar are not completely closed.

19. The longitudinal door system of claim 18, wherein when the first hood is open, the second security seal is not visible.

* * * * *